US011501680B2

(12) United States Patent
Capps

(10) Patent No.: US 11,501,680 B2
(45) Date of Patent: Nov. 15, 2022

(54) INTRA-FIELD SUB CODE TIMING IN FIELD SEQUENTIAL DISPLAYS

(71) Applicant: Magic Leap, Inc., Plantation, FL (US)

(72) Inventor: Marshall Charles Capps, Austin, TX (US)

(73) Assignee: Magic Leap, Inc., Plantation, FL (US)

( * ) Notice: Subject to any disclaimer, the term of this patent is extended or adjusted under 35 U.S.C. 154(b) by 3 days.

(21) Appl. No.: 17/165,823

(22) Filed: Feb. 2, 2021

(65) Prior Publication Data

US 2021/0233453 A1 Jul. 29, 2021

Related U.S. Application Data

(63) Continuation of application No. 16/520,062, filed on Jul. 23, 2019, now Pat. No. 10,943,521.

(60) Provisional application No. 62/702,181, filed on Jul. 23, 2018.

(51) Int. Cl.
*G09G 3/20* (2006.01)

(52) U.S. Cl.
CPC ... *G09G 3/2003* (2013.01); *G09G 2310/0235* (2013.01); *G09G 2310/08* (2013.01); *G09G 2320/0666* (2013.01)

(58) Field of Classification Search
None
See application file for complete search history.

(56) References Cited

U.S. PATENT DOCUMENTS 4,462,165 A 7/1984 Lewis
5,583,974 A 12/1996 Winner et al.
5,684,498 A 11/1997 Welch et al.
5,784,115 A 7/1998 Bozdagi
6,377,401 B1 4/2002 Bartlett
(Continued)

FOREIGN PATENT DOCUMENTS

CA 2358682 A1 3/1994
CN 101093586 A 12/2007
(Continued)

OTHER PUBLICATIONS

U.S. Appl. No. 16/520,062, "Non-Final Office Action", dated Jul. 17, 2020, 15 pages.
(Continued)

*Primary Examiner* — James A Thompson

(74) *Attorney, Agent, or Firm* — Kilpatrick Townsend & Stockton LLP

(57) ABSTRACT

Embodiments provide a computer implemented method for warping multi-field color virtual content for sequential projection. First and second color fields having different first and second colors are obtained. A first time for projection of a warped first color field is determined. A first pose corresponding to the first time is predicted. For each one color among the first colors in the first color field, (a) an input representing the one color among the first colors in the first color field is identified; (b) the input is reconfigured as a series of pulses creating a plurality of per-field inputs; and (c) each one of the series of pulses is warped based on the first pose. The warped first color field is generated based on the warped series of pulses. Pixels on a sequential display are activated based on the warped series of pulses to display the warped first color field.

19 Claims, 25 Drawing Sheets

(56) References Cited

U.S. PATENT DOCUMENTS

| | | | |
|---|---|---|---|
| 6,407,736 | B1 | 6/2002 | Regan |
| 7,375,529 | B2 | 5/2008 | Dupuis et al. |
| 7,443,154 | B1 | 10/2008 | Merewether et al. |
| 8,165,352 | B1 | 4/2012 | Mohanty et al. |
| 8,401,308 | B2 | 3/2013 | Nakamura et al. |
| 8,950,867 | B2 | 2/2015 | Macnamara |
| 9,013,505 | B1 | 4/2015 | Thornton |
| 9,215,293 | B2 | 12/2015 | Miller |
| 9,299,168 | B2 | 3/2016 | Ubillos et al. |
| 9,299,312 | B2 | 3/2016 | Wyatt |
| 9,417,452 | B2 | 8/2016 | Schowengerdt et al. |
| 9,443,355 | B2 | 9/2016 | Chan et al. |
| 9,671,566 | B2 | 6/2017 | Abovitz et al. |
| 9,728,148 | B2 | 8/2017 | Miyata et al. |
| 9,791,700 | B2 | 10/2017 | Schowengerdt |
| 9,874,749 | B2 | 1/2018 | Bradski et al. |
| 10,089,790 | B2 | 10/2018 | Lawson et al. |
| 10,360,832 | B2 | 7/2019 | Ozguner et al. |
| 10,657,869 | B2 | 5/2020 | Telfer et al. |
| 10,762,598 | B2 | 9/2020 | Liebenow et al. |
| 10,771,772 | B2 | 9/2020 | Ukai et al. |
| 10,943,521 | B2 | 3/2021 | Capps |
| 2001/0043738 | A1 | 11/2001 | Sawhney et al. |
| 2002/0180727 | A1 | 12/2002 | Guckenberqer et al. |
| 2003/0092448 | A1 | 5/2003 | Forstrom et al. |
| 2004/0140949 | A1 | 7/2004 | Takagi |
| 2004/0201857 | A1 | 10/2004 | Foxlin |
| 2005/0107870 | A1 | 5/2005 | Wang et al. |
| 2007/0298883 | A1 | 12/2007 | Feldman et al. |
| 2008/0024523 | A1 | 1/2008 | Tomite et al. |
| 2008/0309884 | A1 | 12/2008 | O'Dor et al. |
| 2009/0135129 | A1* | 5/2009 | Roth ..... G09G 3/3413 345/102 |
| 2010/0085423 | A1 | 4/2010 | Lange |
| 2010/0103205 | A1 | 4/2010 | Iisaka et al. |
| 2010/0309292 | A1 | 12/2010 | Ho et al. |
| 2011/0018874 | A1 | 1/2011 | Hasselgren et al. |
| 2011/0184950 | A1 | 7/2011 | Skaff et al. |
| 2011/0199088 | A1 | 8/2011 | Bittar |
| 2011/0238399 | A1 | 9/2011 | Ophir et al. |
| 2011/0248987 | A1 | 10/2011 | Mitchell |
| 2012/0099800 | A1 | 4/2012 | Llano et al. |
| 2012/0117076 | A1 | 5/2012 | Austermann |
| 2012/0194516 | A1 | 8/2012 | Newcombe et al. |
| 2012/0236030 | A1 | 9/2012 | Border et al. |
| 2012/0287139 | A1 | 11/2012 | Wyatt |
| 2012/0287166 | A1 | 11/2012 | Wyatt |
| 2012/0327139 | A1 | 12/2012 | Margulis |
| 2012/0328196 | A1 | 12/2012 | Kasahara et al. |
| 2013/0057644 | A1 | 3/2013 | Stefanoski et al. |
| 2013/0117377 | A1 | 5/2013 | Miller |
| 2013/0169626 | A1 | 7/2013 | Balan et al. |
| 2013/0230211 | A1 | 9/2013 | Tanabiki et al. |
| 2013/0235069 | A1 | 9/2013 | Ubillos et al. |
| 2013/0290222 | A1 | 10/2013 | Gordo et al. |
| 2013/0321462 | A1 | 12/2013 | Salter et al. |
| 2013/0346168 | A1 | 12/2013 | Zhou et al. |
| 2014/0006026 | A1 | 1/2014 | Lamb et al. |
| 2014/0037140 | A1 | 2/2014 | Benhimane et al. |
| 2014/0075060 | A1 | 3/2014 | Sharp et al. |
| 2014/0139226 | A1 | 5/2014 | Jaaskelainen et al. |
| 2014/0176591 | A1 | 6/2014 | Klein et al. |
| 2014/0181587 | A1 | 6/2014 | Sridharan et al. |
| 2014/0212027 | A1 | 7/2014 | Hallquist et al. |
| 2014/0222409 | A1 | 8/2014 | Efrat et al. |
| 2014/0267420 | A1 | 9/2014 | Schowengerdt et al. |
| 2014/0267646 | A1 | 9/2014 | Na'Aman et al. |
| 2014/0306866 | A1 | 10/2014 | Miller et al. |
| 2014/0321702 | A1 | 10/2014 | Schmalstieg |
| 2014/0323148 | A1 | 10/2014 | Schmalstieg et al. |
| 2015/0002542 | A1 | 1/2015 | Chan et al. |
| 2015/0040074 | A1 | 2/2015 | Hofmann et al. |
| 2015/0161476 | A1 | 6/2015 | Kurz et al. |
| 2015/0163345 | A1 | 6/2015 | Cornaby et al. |
| 2015/0172568 | A1 | 6/2015 | Choe et al. |
| 2015/0177831 | A1 | 6/2015 | Chan et al. |
| 2015/0178554 | A1 | 6/2015 | Kanaujia et al. |
| 2015/0178939 | A1 | 6/2015 | Bradski et al. |
| 2015/0205126 | A1 | 7/2015 | Schowengerdt |
| 2015/0215611 | A1 | 7/2015 | Wu et al. |
| 2015/0221133 | A1 | 8/2015 | Groten et al. |
| 2015/0243080 | A1 | 8/2015 | Steinbach et al. |
| 2015/0262372 | A1 | 9/2015 | Cardoso et al. |
| 2015/0302652 | A1 | 10/2015 | Miller et al. |
| 2015/0324198 | A1 | 11/2015 | Alsup et al. |
| 2015/0339857 | A1 | 11/2015 | O'Connor et al. |
| 2015/0346495 | A1 | 12/2015 | Welch et al. |
| 2015/0358539 | A1 | 12/2015 | Catt |
| 2015/0373369 | A1 | 12/2015 | Jalali et al. |
| 2015/0379772 | A1 | 12/2015 | Hoffman |
| 2016/0012643 | A1 | 1/2016 | Kezele et al. |
| 2016/0026253 | A1 | 1/2016 | Bradski et al. |
| 2016/0104444 | A1 | 4/2016 | Miyata et al. |
| 2016/0147065 | A1 | 5/2016 | Border et al. |
| 2016/0171644 | A1 | 6/2016 | Gruber |
| 2016/0180151 | A1 | 6/2016 | Philbin et al. |
| 2016/0189680 | A1 | 6/2016 | Paquette |
| 2016/0210783 | A1 | 7/2016 | Tomlin et al. |
| 2016/0259404 | A1 | 9/2016 | Woods |
| 2016/0282619 | A1 | 9/2016 | Oto et al. |
| 2016/0299567 | A1 | 10/2016 | Crisler et al. |
| 2016/0378863 | A1 | 12/2016 | Shlens et al. |
| 2016/0379092 | A1 | 12/2016 | Kutliroff |
| 2017/0011555 | A1 | 1/2017 | Li et al. |
| 2017/0018121 | A1 | 1/2017 | Lawson et al. |
| 2017/0032220 | A1 | 2/2017 | Medasani et al. |
| 2017/0098406 | A1 | 4/2017 | Kobayashi |
| 2017/0161919 | A1 | 6/2017 | Schroeder et al. |
| 2017/0205903 | A1 | 7/2017 | Miller et al. |
| 2017/0243324 | A1 | 8/2017 | Mierle et al. |
| 2017/0287377 | A1 | 10/2017 | Telfer et al. |
| 2017/0345398 | A1 | 11/2017 | Fuchs et al. |
| 2018/0039083 | A1 | 2/2018 | Miller et al. |
| 2018/0047332 | A1 | 2/2018 | Kuwahara et al. |
| 2018/0053284 | A1 | 2/2018 | Rodriguez et al. |
| 2018/0213359 | A1 | 7/2018 | Reinhardt et al. |
| 2018/0268518 | A1 | 9/2018 | Nourai et al. |
| 2018/0268519 | A1 | 9/2018 | Liebenow et al. |
| 2018/0268610 | A1 | 9/2018 | Nourai et al. |
| 2019/0015167 | A1 | 1/2019 | Draelos et al. |
| 2019/0051229 | A1 | 2/2019 | Ozguner et al. |
| 2019/0068959 | A1 | 2/2019 | Ukai et al. |
| 2019/0155374 | A1 | 5/2019 | Miller et al. |
| 2020/0027385 | A1* | 1/2020 | Capps ..... G09G 3/001 |
| 2020/0050264 | A1 | 2/2020 | Kruzel et al. |
| 2021/0358452 | A1* | 11/2021 | Crounse ..... G09G 3/2059 |

FOREIGN PATENT DOCUMENTS

| | | | |
|---|---|---|---|
| CN | 101530325 | A | 9/2009 |
| CN | 103792661 | A | 5/2014 |
| CN | 104011788 | A | 8/2014 |
| EP | 0664917 | A1 | 8/1995 |
| EP | 2887311 | A1 | 6/2015 |
| WO | 9720244 | A1 | 6/1997 |
| WO | 2014160342 | A1 | 10/2014 |
| WO | 2015134958 | A1 | 9/2015 |
| WO | 2016141373 | A1 | 9/2016 |
| WO | 2017096396 | A1 | 6/2017 |
| WO | 2017136833 | A1 | 8/2017 |
| WO | 2018203324 | A1 | 11/2018 |

OTHER PUBLICATIONS

U.S. Appl. No. 16/520,062, "Notice of Allowance", dated Nov. 3, 2020, 12 pages.

Bay, et al., "SURF: Speeded Up Robust Features", International Conference on Simulation, Modeling and Programming for Autonomous Robots, May 7, 2006, 14 pages.

Coillot, et al., "New Ferromagnetic Core Shapes for Induction Sensors", Journal of Sensors and Sensor System, vol. 3, 2014, pp. 1-8.

(56) References Cited

OTHER PUBLICATIONS

Kendall, et al., "Pose Net: A Convolutional Metwork for Real-Time 6-DOF Camera Relocalization", Available Online at: https://arxiv.org/pdf/1505.07427v3.pdf, Nov. 23, 2015, 9 pages.
Nair, et al., "A Survey on Time-of-Flight Stereo Fusion", Medical Image Computing and Computer Assisted Intervention, XP047148654, Sep. 11, 2013, 21 pages.
Ng, et al., "Exploiting Local Features from Deep Networks for Image Retrieval", IEEE Conference on Computer Vision and Pattern recognition workshops, (CVPRW), Jun. 7, 2015, 9 pages.
PCT/US2019/043057, "International Search Report and Written Opinion", dated Oct. 16, 2019, 9 pages.
Song, et al., "Fast Estimation of Relative Poses for 6-DOF Image Localization", IEEE International Conference on Multimedia Big Data, Apr. 20-22, 2015, 8 pages.
Tian, et al., "View Synthesis Techniques for 3D Video", Applications of Digital Image Processing XXXII; 74430T, Proc. SPIE, vol. 7443, Sep. 2, 2009, 12 pages.
Zhu, et al., "Joint Depth and Alpha Matte Optimization via Fusion of Stereo and Time-of-flight Sensor", Conference on Computer Vision and Pattern recognition (CVPR), IEEE, XP002700137, Jun. 20, 2009, pp. 453-460.
Application No. EP19839969.3 , Extended European Search Report, dated Aug. 9, 2021, 11 pages.
Application No. PCT/US2019/043057 , International Preliminary Report on Patentability, dated Feb. 4, 2021, 8 pages.
AU2021290369, "First Examination Report", dated Mar. 29, 2022, 3 pages.
IN201947040457, "Examination Report", dated Feb. 3, 2022, 8 pages.
Application No. JP2022-002800, Office Action and English Translation, dated Feb. 8, 2022, 5 pages.

* cited by examiner

INTRA-FIELD SUB CODE TIMING IN FIELD SEQUENTIAL DISPLAYS

CROSS-REFERENCE TO RELATED APPLICATIONS

This application is a continuation of U.S. patent application Ser. No. 16/520,062, filed on Jul. 23, 2019, now U.S. Pat. No. 10,943,521, issued on Mar. 9, 2021, entitled "INTRA-FIELD SUB CODE TIMING IN FIELD SEQUENTIAL DISPLAYS," which is a non-provisional of and claims the benefit of and priority to U.S. Provisional Patent Application No. 62/702,181, filed on Jul. 23, 2018, entitled "INTRA-FIELD SUB CODE TIMING IN FIELD SEQUENTIAL DISPLAYS," which are hereby incorporated by reference in their entirety for all purposes.

The present application is related to U.S. patent application Ser. No. 15/924,078, filed on Mar. 16, 2018, now U.S. Pat. No. 10,762,598, issued on Sep. 1, 2020, entitled "MIXED REALITY SYSTEM WITH COLOR VIRTUAL CONTENT WARPING AND METHOD OF GENERATING VIRTUAL CONTENT USING SAME," the contents of which are hereby incorporated by reference in their entirety.

FIELD OF THE INVENTION

The present disclosure relates to field sequential display systems projecting one or more color codes at different geometric positions over time for virtual content, and methods for generating a mixed reality experience content using the same.

BACKGROUND

Modern computing and display technologies have facilitated the development of "mixed reality" (MR) systems for so called "virtual reality" (VR) or "augmented reality" (AR) experiences, wherein digitally reproduced images or portions thereof are presented to a user in a manner wherein they seem to be, or may be perceived as, real. A VR scenario typically involves presentation of digital or virtual image information without transparency to actual real-world visual input. An AR scenario typically involves presentation of digital or virtual image information as an augmentation to visualization of the real world around the user (i.e., transparency to real-world visual input). Accordingly, AR scenarios involve presentation of digital or virtual image information with transparency to the real-world visual input.

MR systems typically generate and display color data, which increases the realism of MR scenarios. Many of these MR systems display color data by sequentially projecting sub-images in different (e.g., primary) colors or "fields" (e.g., Red, Green, and Blue) corresponding to a color image in rapid succession. Projecting color sub-images at sufficiently high rates (e.g., 60 Hz, 120 Hz, etc.) may deliver a smooth color MR scenarios in a user's mind.

Various optical systems generate images, including color images, at various depths for displaying MR (VR and AR) scenarios. Some such optical systems are described in U.S. Utility patent application Ser. No. 14/555,585 filed on Nov. 27, 2014, the contents of which are hereby expressly and fully incorporated by reference in their entirety, as though set forth in full.

MR systems typically employ wearable display devices (e.g., head-worn displays, helmet-mounted displays, or smart glasses) that are at least loosely coupled to a user's head, and thus move when the user's head moves. If the user's head motions are detected by the display device, the data being displayed can be updated to take the change in head pose (i.e., the orientation and/or location of user's head) into account. Changes in position present challenges to field sequential display technology.

SUMMARY

Described herein are techniques and technologies to improve image quality of field sequential displays subject to motion that intend to project a stationary image.

As an example, if a user wearing a head-worn display device views a virtual representation of a virtual object on the display and walks around an area where the virtual object appears, the virtual object can be rendered for each viewpoint, giving the user the perception that they are walking around an object that shares a relationship with real space as opposed to a relationship with the display surface. A change in a user's head pose, however, changes and to maintain a stationary image projection from a dynamic display system requires adjusting the timing of field sequential projectors.

Conventional field sequential display may project colors for a single image frame in a designated time sequence, and any difference in time between fields is not noticed when viewed on a stationary display. For example, a red pixel displayed at a first time, and a blue pixel displayed 10 ms later will appear to overlap, as the geometric position of the pixels does not change in a discernible amount of time.

In a moving projector, however, such as a head-worn display, motion in that same 10 ms interval may correspond to a noticeable shift in the red and blue pixel that were intended to overlap.

In some embodiments, warping an individual image's color within the field sequence can improve the perception of the image, as each frame will be based on the field's appropriate perspective at a given time in a change in head pose. Such methods and systems to implement this solution are described in U.S. patent application Ser. No. 15/924,078.

In addition to the specific field warping that should occur to correct for general head pose changes in field sequential displays, a given field's sub codes themselves should be adjusted to appropriately convey rich imagery representing intended colors.

In one embodiment, a computer implemented method for warping multi-field color virtual content for sequential projection includes obtaining first and second color fields having different first and second colors. The method also includes determining a first time for projection of a warped first color field. The method further includes predicting a first pose corresponding to the first time. For each one color among the first colors in the first color field, the method includes (a) identifying an input representing the one color among the first colors in the first color field; (b) reconfiguring the input as a series of pulses creating a plurality of per-field inputs; and (c) warping each one of the series of pulses based on the first pose. The method also includes generating the warped first color field based on the warped series of pulses. In addition, the method includes activating pixels on a sequential display based on the warped series of pulses to display the warped first color field.

In one or more embodiments, the series of pulses includes a central pulse centered at the first time, a second pulse occurring before the central pulse and a third pulse occurring after the central pulse. An end of a decay phase of the second pulse is temporally aligned with a beginning of a growth phase of the central pulse, and a beginning of a growth phase of the third pulse is temporally aligned with an end of a decay phase of the central pulse. A centroid of the central pulse occurs at the first time, a centroid of the second pulse occurs at a second time before the first time, and a centroid of the third pulse occurs at a third time after the first time. In some embodiments, a difference between the first time and the second time is equal to a difference between the first time and the third time. In some embodiments, the central pulse includes a first set of time slots each having a first duration, the second pulse and the third pulse includes a second set of time slots each having a second duration greater than the first duration. The pixels on the sequential display are activated during a subset of the first set of time slots or the second set of time slots. In some embodiments, the pixels on the sequential display are activated during time slots of the central pulse depending on a color code associated with the one color among the first colors in the first color field. In various embodiments, the pixels on the sequential display are activated for a time slot in the second pulse and a corresponding time slot in the third pulse.

In one or more embodiments, the method may also include determining a second time for projection of a warped second color field. The method may further include predicting a second pose corresponding to the second time. For each one color among the second colors in the second color field, the method may include (a) identifying an input representing the one color among the second colors in the second color field; (b) reconfiguring the input as a series of pulses creating a plurality of per-field inputs; and (c) warping each one of the series of pulses based on the second pose. The method may also include generating the warped second color field based on the warped series of pulses. In addition, the method may include activating pixels on a sequential display based on the warped series of pulses to display the warped second color field based on the warped series of pulses.

In another embodiment, a system for warping multi-field color virtual content for sequential projection includes a warping unit to receive first and second color fields having different first and second colors for sequential projection. The warping unit includes a pose estimator to determine a first time for projection of a warped first color field and to predict a first pose corresponding to the first time. The warping unit also includes a transform unit to, for each one color among the first colors in the first color field, (a) identify an input representing the one color among the first colors in the first color field; (b) reconfigure the input as a series of pulses creating a plurality of per-field inputs; and (c) warp each one of the series of pulses based on the first pose. The transform unit is further configured to generate the warped first color field based on the warped series of pulses. The transform unit is also configured to activate pixels on a sequential display based on the warped series of pulses to display the warped first color field.

In still another embodiment, a computer program product is embodied in a non-transitory computer readable medium, the computer readable medium having stored thereon a sequence of instructions which, when executed by a processor causes the processor to execute a method for warping multi-field color virtual content for sequential projection. The method includes obtaining first and second color fields having different first and second colors. The method also includes determining a first time for projection of a warped first color field. The method further includes predicting a first pose corresponding to the first time. For each one color among the first colors in the first color field, the method includes (a) identifying an input representing the one color among the first colors in the first color field; (b) reconfiguring the input as a series of pulses creating a plurality of per-field inputs; and (c) warping each one of the series of pulses based on the first pose. The method also includes generating the warped first color field based on the warped series of pulses. In addition, the method includes activating pixels on a sequential display based on the warped series of pulses to display the warped first color field.

In one embodiment, a computer implemented method for warping multi-field color virtual content for sequential projection includes obtaining first and second color fields having different first and second colors. The method also includes determining a first time for projection of a warped first color field. The method further includes determining a second time for projection of a warped second color field. Moreover, the method includes predicting a first pose at the first time and predicting a second pose at the second time. In addition, the method includes generating the warped first color field by warping the first color field based on the first pose. The method also includes generating the warped second color field by warping the second color field based on the second pose.

In one or more embodiments, the first color field includes first color field information at an X, Y location. The first color field information may include a first brightness in the first color. The second color field may include second image information at the X, Y location. The second color field information may include a second brightness in the second color.

In one or more embodiments, the warped first color field includes warped first color field information at a first warped X, Y location. The warped second color field may include warped second color field information at a second warped X, Y location. Warping the first color field based on the first pose may include applying a first transformation to the first color field to generate the warped first color field. Warping the second color field based on the second pose may include applying a second transformation to the second color field to generate the warped second color field.

In one or more embodiments, the method also includes sending the warped first and second color fields to a sequential projector, and the sequential projector sequentially projecting the warped first color field and the warped second color field. The warped first color field may be projected at the first time, and the warped second color field may be projected at the second time.

In another embodiment, a system for warping multi-field color virtual content for sequential projection includes a warping unit to receive first and second color fields having different first and second colors for sequential projection. The warping unit includes a pose estimator to determine first and second times for projection of respective warped first and second color fields, and to predict first and second poses at respective first and second times. The warping unit also includes a transform unit to generate the warped first and second color fields by warping respective first and second color fields based on respective first and second poses.

In still another embodiment, a computer program product is embodied in a non-transitory computer readable medium, the computer readable medium having stored thereon a sequence of instructions which, when executed by a processor causes the processor to execute a method for warping multi-field color virtual content for sequential projection. The method includes obtaining first and second color fields having different first and second colors. The method also includes determining a first time for projection of a warped first color field. The method further includes determining a second time for projection of a warped second color field. Moreover, the method includes predicting a first pose at the first time and predicting a second pose at the second time. In addition, the method includes generating the warped first color field by warping the first color field based on the first pose. The method also includes generating the warped second color field by warping the second color field based on the second pose.

In yet another embodiment, a computer implemented method for warping multi-field color virtual content for sequential projection includes obtaining an application frame and an application pose. The method also includes estimating a first pose for a first warp of the application frame at a first estimated display time. The method further includes performing a first warp of the application frame using the application pose and the estimated first pose to generate a first warped frame. Moreover, the method includes estimating a second pose for a second warp of the first warped frame at a second estimated display time. In addition, the method includes performing a second warp of the first warp frame using the estimated second pose to generate a second warped frame.

In one or more embodiments, the method includes displaying the second warped frame at about the second estimated display time. The method may also include estimating a third pose for a third warp of the first warped frame at a third estimated display time, and performing a third warp of the first warp frame using the estimated third pose to generate a third warped frame. The third estimated display time may be later than the second estimated display time. The method may also include displaying the third warped frame at about the third estimated display time.

In another embodiment, a computer implemented method for minimizing Color Break Up ("CBU") artifacts includes predicting a CBU artifact based on received eye or head tracking information, The method also includes increasing a color field rate based on the predicted CBU artifact.

In one or more embodiments, the method includes predicting a second CBU based on the received eye or head tracking information and the increased color field rate, and decreasing a bit depth based on the predicted second CBU artifact. The method may also include displaying an image using the increased color field rate and the decreased bit depth. The method may further include displaying an image using the increased color field rate.

Additional and other objects, features, and advantages of the disclosure are described in the detail description, figures and claims.

BRIEF DESCRIPTION OF THE DRAWINGS

The drawings illustrate the design and utility of various embodiments of the present disclosure. It should be noted that the figures are not drawn to scale and that elements of similar structures or functions are represented by like reference numerals throughout the figures. In order to better appreciate how to obtain the above-recited and other advantages and objects of various embodiments of the disclosure, a more detailed description of the present disclosures briefly described above will be rendered by reference to specific embodiments thereof, which are illustrated in the accompanying drawings. Understanding that these drawings depict only typical embodiments of the disclosure and are not therefore to be considered limiting of its scope, the disclosure will be described and explained with additional specificity and detail through the use of the accompanying drawings in which.

DETAILED DESCRIPTION

Various embodiments of the disclosure are directed to systems, methods, and articles of manufacture for warping virtual content from him a source in a single embodiment or in multiple embodiments. Other objects, features, and advantages of the disclosure are described in the detailed description, figures, and claims.

Various embodiments will now be described in detail with reference to the drawings, which are provided as illustrative examples of the disclosure so as to enable those skilled in the art to practice the disclosure. Notably, the figures and the examples below are not meant to limit the scope of the present disclosure. Where certain elements of the present disclosure may be partially or fully implemented using known components (or methods or processes), only those portions of such known components (or methods or processes) that are necessary for an understanding of the present disclosure will be described, and the detailed descriptions of other portions of such known components (or methods or processes) will be omitted so as not to obscure the disclosure. Further, various embodiments encompass present and future known equivalents to the components referred to herein by way of illustration.

The virtual content warping systems may be implemented independently of mixed reality systems, but some embodiments below are described in relation to AR systems for illustrative purposes only. Further, the virtual content warping systems described herein may also be used in an identical manner with VR systems.

Illustrative Mixed Reality Scenario and System

The description that follows pertains to an illustrative augmented reality system with which the warping system may be practiced. However, it is to be understood that the embodiments also lends themselves to applications in other types of display systems (including other types of mixed reality systems), and therefore the embodiments are not to be limited to only the illustrative system disclosed herein.

Figure 1:
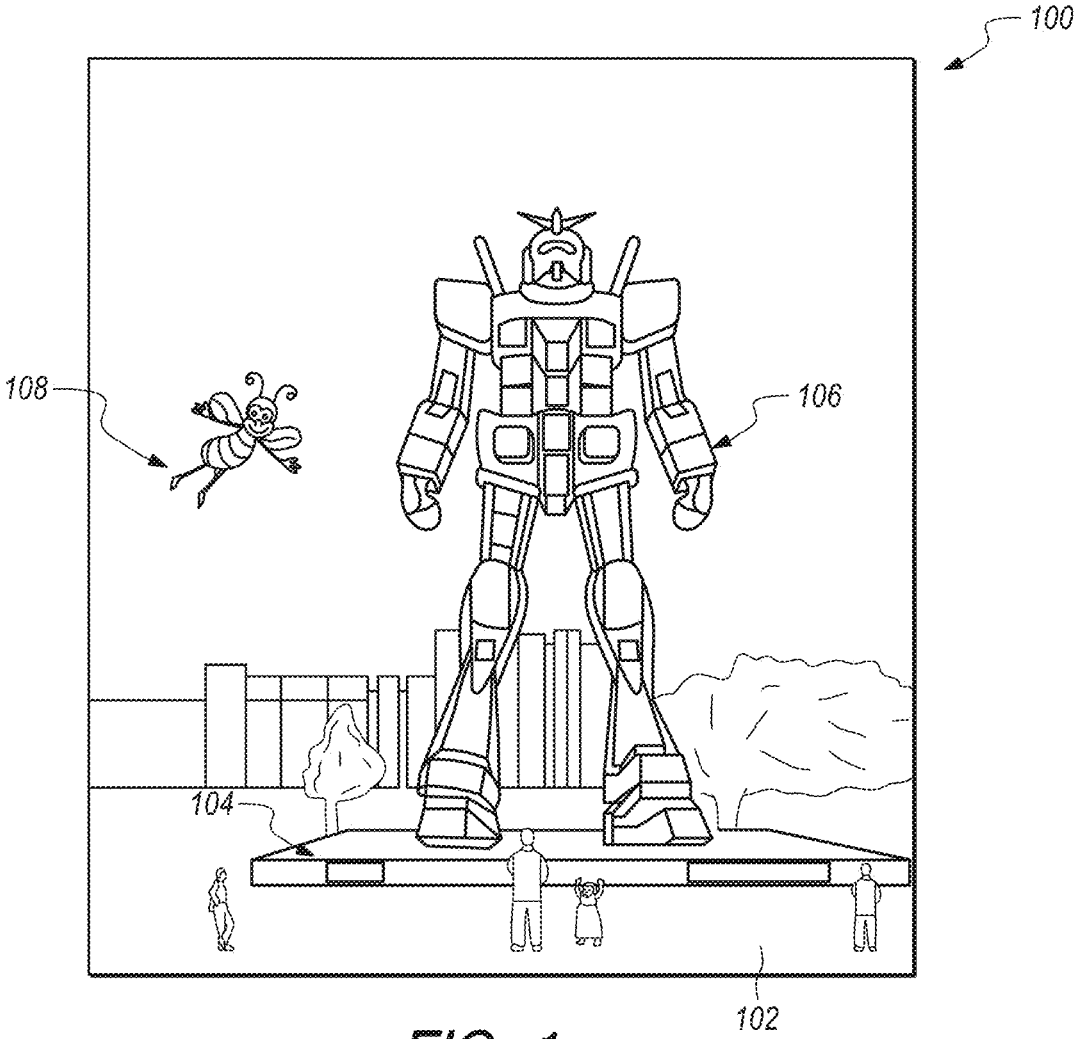
FIG. 1 depicts a user's view of augmented reality (AR) through a wearable AR user device, according to some embodiments.

Mixed reality (e.g., VR or AR) scenarios often include presentation of virtual content (e.g., color images and sound) corresponding to virtual objects in relationship to real-world objects. For example, referring to FIG. 1, an augmented reality (AR) scene 100 is depicted wherein a user of an AR technology sees a real-world, physical, park-like setting 102 featuring people, trees, buildings in the background, and a real-world, physical concrete platform 104. In addition to these items, the user of the AR technology also perceives that they "sees" a virtual robot statue 106 standing upon the physical concrete platform 104, and a virtual cartoon-like avatar character 108 flying by which seems to be a personification of a bumblebee, even though these virtual objects 106, 108 do not exist in the real-world.

Like AR scenarios, VR scenarios must also account for the poses used to generate/render the virtual content. Accurately warping the virtual content to the AR/VR display frame of reference and warping the warped virtual content can improve the AR/VR scenarios, or at least not detract from the AR/VR scenarios.

The description that follows pertains to an illustrative AR system with which the disclosure may be practiced. However, it is to be understood that the disclosure also lends itself to applications in other types of augmented reality and virtual reality systems, and therefore the disclosure is not to be limited to only the illustrative system disclosed herein.

Figure 2A:
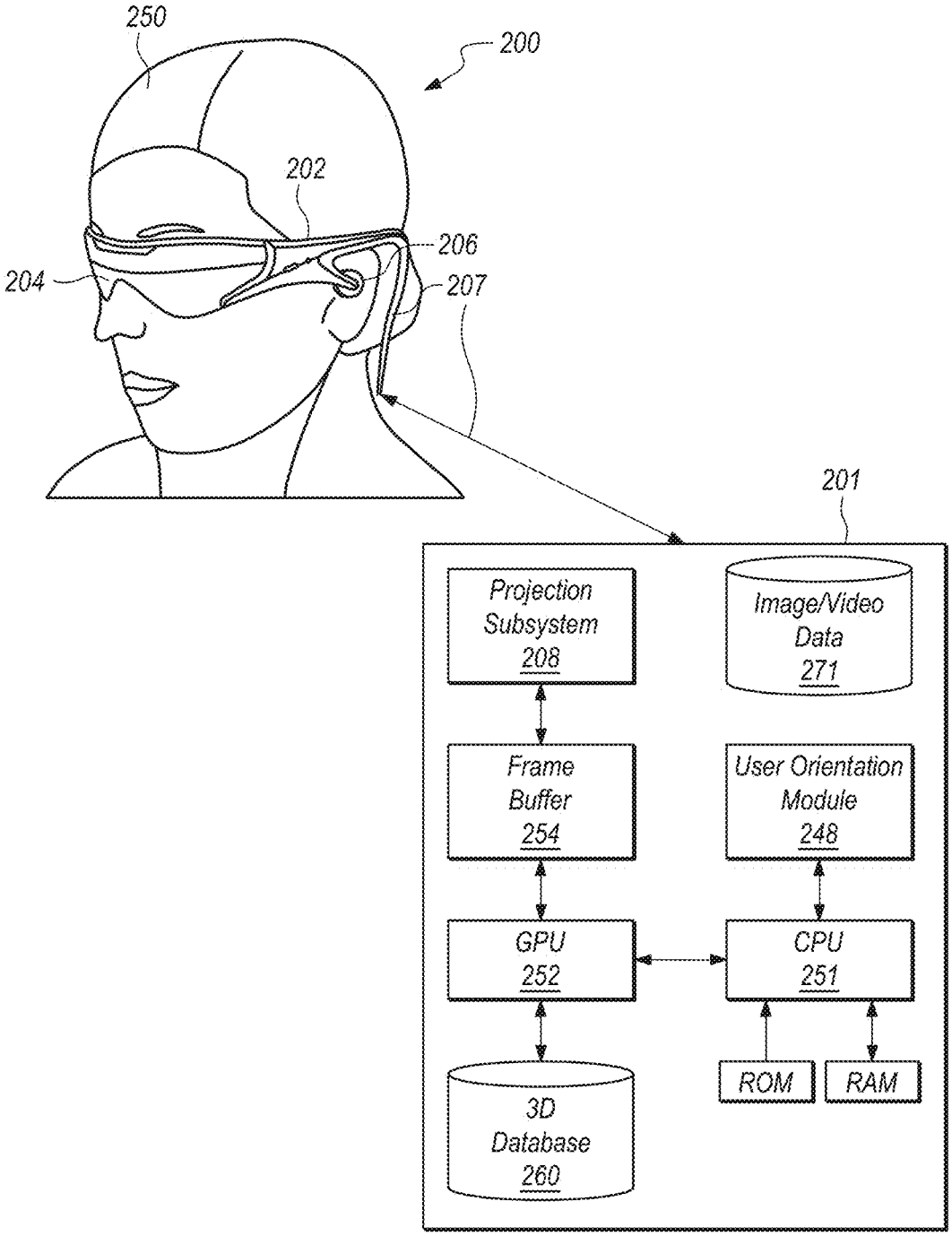
FIGS. 2A-2C schematically depict AR systems and subsystems thereof, according to some embodiments.

Referring to FIG. 2A, one embodiment of an AR system 200, according to some embodiments. The AR system 200 may be operated in conjunction with a projection subsystem 208, providing images of virtual objects intermixed with physical objects in a field of view of a user 250. This approach employs one or more at least partially transparent surfaces through which an ambient environment including the physical objects can be seen and through which the AR system 200 produces images of the virtual objects. The projection subsystem 208 is housed in a control subsystem 201 operatively coupled to a display system/subsystem 204 through a link 207. The link 207 may be a wired or wireless communication link.

For AR applications, it may be desirable to spatially position various virtual objects relative to respective physical objects in a field of view of the user 250. The virtual objects may take any of a large variety of forms, having any variety of data, information, concept, or logical construct capable of being represented as an image. Non-limiting examples of virtual objects may include: a virtual text object, a virtual numeric object, a virtual alphanumeric object, a virtual tag object, a virtual field object, a virtual chart object, a virtual map object, a virtual instrumentation object, or a virtual visual representation of a physical object.

The AR system 200 comprises a frame structure 202 worn by the user 250, the display system 204 carried by the frame structure 202, such that the display system 204 is positioned in front of the eyes of the user 250, and a speaker 206 incorporated into or connected to the display system 204. In the illustrated embodiment, the speaker 206 is carried by the frame structure 202, such that the speaker 206 is positioned adjacent (in or around) the ear canal of the user 250, e.g., an earbud or headphone.

The display system 204 is designed to present the eyes of the user 250 with photo-based radiation patterns that can be comfortably perceived as augmentations to the ambient environment including both two-dimensional and three-dimensional content. The display system 204 presents a sequence of frames at high frequency that provides the perception of a single coherent scene. To this end, the display system 204 includes the projection subsystem 208 and a partially transparent display screen through which the projection subsystem 208 projects images. The display screen is positioned in a field of view of the user 250 between the eyes of the user 250 and the ambient environment.

In some embodiments, the projection subsystem 208 takes the form of a scan-based projection device and the display screen takes the form of a waveguide-based display into which the scanned light from the projection subsystem 208 is injected to produce, for example, images at single optical viewing distance closer than infinity (e.g., arm's length), images at multiple, discrete optical viewing distances or focal planes, and/or image layers stacked at multiple viewing distances or focal planes to represent volumetric 3D objects. These layers in the light field may be stacked closely enough together to appear continuous to the human visual subsystem (e.g., one layer is within the cone of confusion of an adjacent layer). Additionally or alternatively, picture elements may be blended across two or more layers to increase perceived continuity of transition between layers in the light field, even if those layers are more sparsely stacked (e.g., one layer is outside the cone of confusion of an adjacent layer). The display system 204 may be monocular or binocular. The scanning assembly includes one or more light sources that produce the light beam (e.g., emits light of different colors in defined patterns). The light source may take any of a large variety of forms, for instance, a set of RGB sources (e.g., laser diodes capable of outputting red, green, and blue light) operable to respectively produce red, green, and blue coherent collimated light according to defined pixel patterns specified in respective frames of pixel information or data. Laser light provides high color saturation and is highly energy efficient. The optical coupling subsystem includes an optical waveguide input apparatus, such as for instance, one or more reflective surfaces, diffraction gratings, mirrors, dichroic mirrors, or prisms to optically couple light into the end of the display screen. The optical coupling subsystem further includes a collimation element that collimates light from the optical fiber. Optionally, the optical coupling subsystem includes an optical modulation apparatus configured for converging the light from the collimation element towards a focal point in the center of the optical waveguide input apparatus, thereby allowing the size of the optical waveguide input apparatus to be minimized. Thus, the display subsystem 204 generates a series of synthetic image frames of pixel information that present an undistorted image of one or more virtual objects to the user. The display subsystem 204 may also generate a series of color synthetic sub-image frames of pixel information that present an undistorted color image of one or more virtual objects to the user. Further details describing display subsystems are provided in U.S. Utility patent application Ser. No. 14/212,961, entitled "Display System and Method", and Ser. No. 14/331,218, entitled "Planar Waveguide Apparatus With Diffraction Element(s) and Subsystem Employing Same", the contents of which are hereby expressly and fully incorporated by reference in their entirety, as though set forth in full.

The AR system 200 further includes one or more sensors mounted to the frame structure 202 for detecting the position (including orientation) and movement of the head of the user 250 and/or the eye position and inter-ocular distance of the user 250. Such sensor(s) may include image capture devices, microphones, inertial measurement units (IMUs), accelerometers, compasses, GPS units, radio devices, gyros and the like. For example, in one embodiment, the AR system 200 includes a head worn transducer subsystem that includes one or more inertial transducers to capture inertial measures indicative of movement of the head of the user 250. Such devices may be used to sense, measure, or collect information about the head movements of the user 250. For instance, these devices may be used to detect/measure movements, speeds, acceleration and/or positions of the head of the user 250. The position (including orientation) of the head of the user 250 is also known as a "head pose" of the user 250.

The AR system 200 of FIG. 2A may include one or more forward facing cameras. The cameras may be employed for any number of purposes, such as recording of images/video from the forward direction of the system 200. In addition, the cameras may be used to capture information about the environment in which the user 250 is located, such as information indicative of distance, orientation, and/or angular position of the user 250 with respect to that environment and specific objects in that environment.

The AR system 200 may further include rearward facing cameras to track angular position (the direction in which the eye or eyes are pointing), blinking, and depth of focus (by detecting eye convergence) of the eyes of the user 250. Such eye tracking information may, for example, be discerned by projecting light at the end user's eyes, and detecting the return or reflection of at least some of that projected light.

The augmented reality system 200 further includes a control subsystem 201 that may take any of a large variety of forms. The control subsystem 201 includes a number of controllers, for instance one or more microcontrollers, microprocessors or central processing units (CPUs), digital signal processors, graphics processing units (GPUs), other integrated circuit controllers, such as application specific integrated circuits (ASICs), programmable gate arrays (PGAs), for instance field PGAs (FPGAs), and/or programmable logic controllers (PLUs). The control subsystem 201 may include a digital signal processor (DSP), a central processing unit (CPU) 251, a graphics processing unit (GPU) 252, and one or more frame buffers 254. The CPU 251 controls overall operation of the system, while the GPU 252 renders frames (i.e., translating a three-dimensional scene into a two-dimensional image) and stores these frames in the frame buffer(s) 254. While not illustrated, one or more additional integrated circuits may control the reading into and/or reading out of frames from the frame buffer(s) 254 and operation of the display system 204. Reading into and/or out of the frame buffer(s) 254 may employ dynamic addressing, for instance, where frames are over-rendered. The control subsystem 201 further includes a read only memory (ROM) and a random access memory (RAM). The control subsystem 201 further includes a three-dimensional database 260 from which the GPU 252 can access three-dimensional data of one or more scenes for rendering frames, as well as synthetic sound data associated with virtual sound sources contained within the three-dimensional scenes.

The augmented reality system 200 further includes a user orientation detection module 248. The user orientation module 248 detects the instantaneous position of the head of the user 250 and may predict the position of the head of the user 250 based on position data received from the sensor(s). The user orientation module 248 also tracks the eyes of the user 250, and in particular the direction and/or distance at which the user 250 is focused based on the tracking data received from the sensor(s).

Figure 2B:
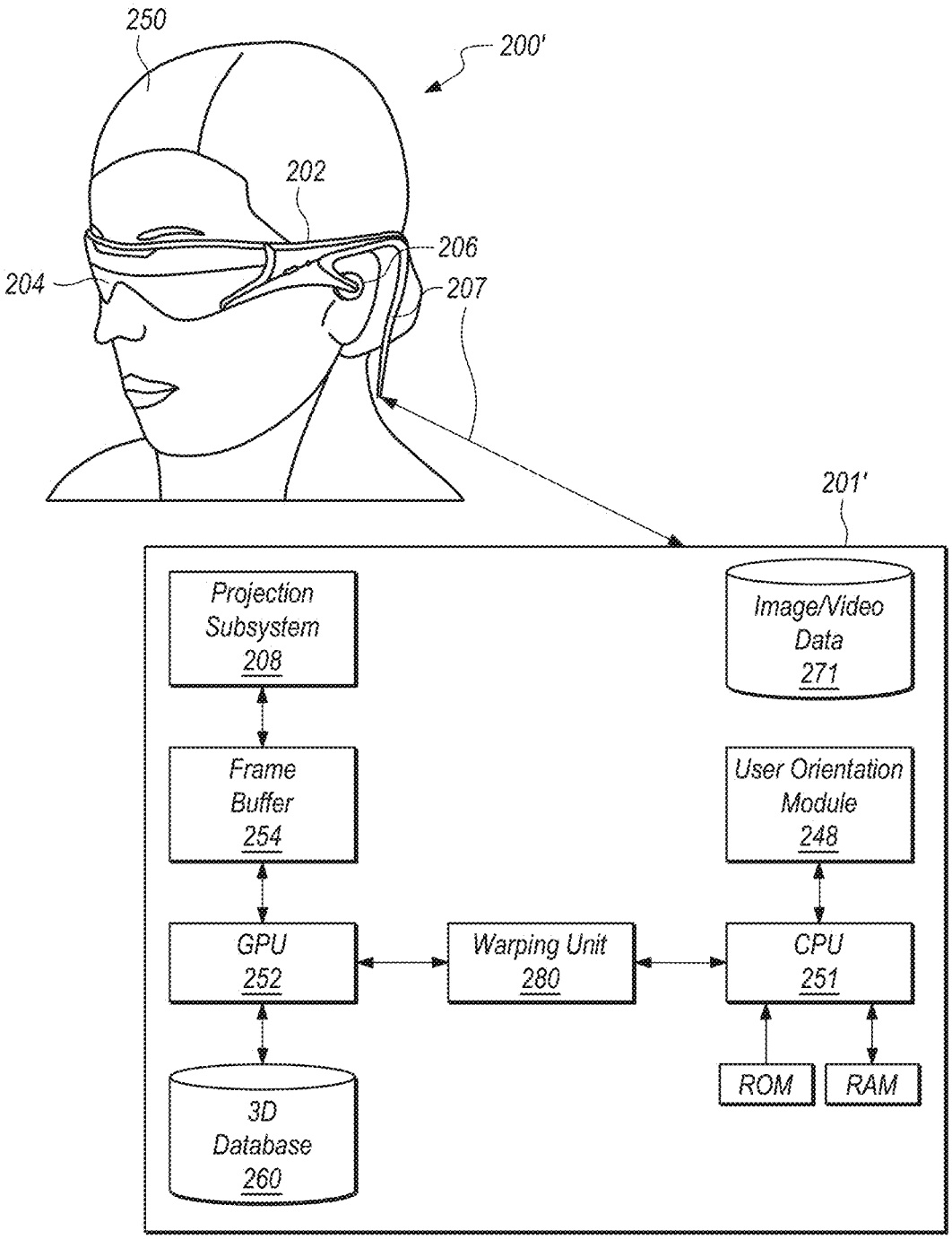

FIG. 2B depicts an AR system 200', according to some embodiments. The AR system 200' depicted in FIG. 2B is similar to the AR system 200 depicted in FIG. 2A and describe above. For instance, AR system 200' includes a frame structure 202, a display system 204, a speaker 206, and a control subsystem 201' operatively coupled to the display subsystem 204 through a link 207. The control subsystem 201' depicted in FIG. 2B is similar to the control subsystem 201 depicted in FIG. 2A and describe above. For instance, control subsystem 201' includes a projection subsystem 208, an image/video database 271, a user orientation module 248, a CPU 251, a GPU 252, a 3D database 260, ROM and RAM.

Figure 2C:
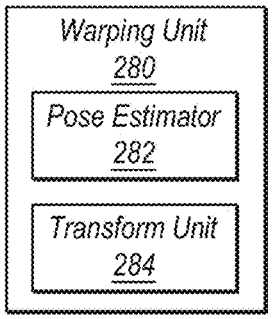

The difference between the control subsystem 201', and thus the AR system 200', depicted in FIG. 2B from the corresponding system/system component depicted in FIG. 2A, is the presence of warping unit 280 in the control subsystem 201' depicted in FIG. 2B. The warping unit 280 is a separate warping block that is independent from either the GPU 252 or the CPU 251. In other embodiments, warping unit 280 may be a component in a separate warping block. In some embodiments, the warping unit 280 may be inside the GPU 252. In some embodiments, the warping unit 280 may be inside the CPU 251. FIG. 2C shows that the warping unit 280 includes a pose estimator 282 and a transform unit 284.

The various processing components of the AR systems 200, 200' may be contained in a distributed subsystem. For example, the AR systems 200, 200' include a local processing and data module (i.e., the control subsystem 201, 201') operatively coupled, such as by a wired lead or wireless connectivity 207, to a portion of the display system 204. The local processing and data module may be mounted in a variety of configurations, such as fixedly attached to the frame structure 202, fixedly attached to a helmet or hat, embedded in headphones, removably attached to the torso of the user 250, or removably attached to the hip of the user 250 in a belt-coupling style configuration. The AR systems 200, 200' may further include a remote processing module and remote data repository operatively coupled, such as by a wired lead or wireless connectivity to the local processing and data module, such that these remote modules are operatively coupled to each other and available as resources to the local processing and data module. The local processing and data module may include a power-efficient processor or controller, as well as digital memory, such as flash memory, both of which may be utilized to assist in the processing, caching, and storage of data captured from the sensors and/or acquired and/or processed using the remote processing module and/or remote data repository, possibly for passage to the display system 204 after such processing or retrieval. The remote processing module may comprise one or more relatively powerful processors or controllers configured to analyze and process data and/or image information. The remote data repository may comprise a relatively large-scale digital data storage facility, which may be available through the internet or other networking configuration in a "cloud" resource configuration. In some embodiments, all data is stored and all computation is performed in the local processing and data module, allowing fully autonomous use from any remote modules. The couplings between the various components described above may include one or more wired interfaces or ports for providing wires or optical communications, or one or more wireless interfaces or ports, such as via RF, microwave, and IR for providing wireless communications. In some implementations, all communications may be wired, while in other implementations all communications may be wireless, with the exception of the optical fiber(s).

Summary of Problems and Solutions

Figure 3:
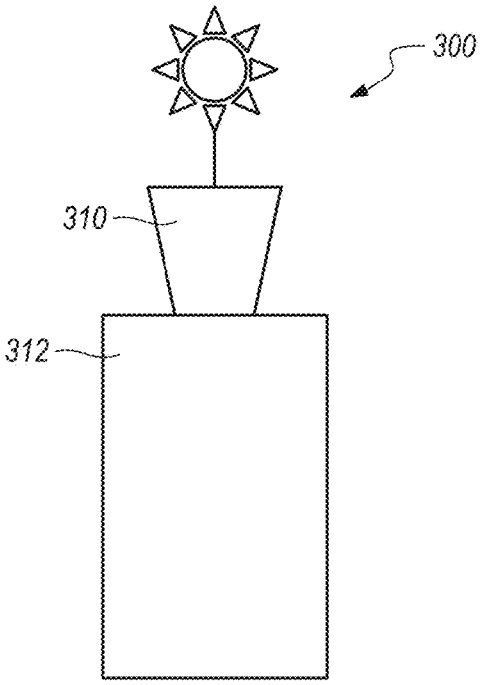
FIGS. 3 and 4 illustrate a rendering artifact with rapid head movement, according to some embodiments.

When an optical system generates/renders color virtual content, it may use a source frame of reference that may be related to a pose of the system when the virtual content is rendered. In AR systems, the rendered virtual content may have a predefined relationship with a real physical object. For instance, FIG. 3 illustrates an AR scenario 300 including a virtual flower pot 310 positioned on top of a real physical pedestal 312. An AR system rendered the virtual flower pot 310 based on a source frame of references in which the location of a real pedestal 312 is known such that the virtual flower pot 310 appears to be resting on top of the real pedestal 312. The AR system may, at a first time, render the virtual flower pot 310 using a source frame of reference, and, at a second time after the first time, display/project the rendered virtual flower pot 310 at an output frame of reference. If the source frame of reference and the output frame of reference are the same, the virtual flower pot 310 will appear where it is intended to be (e.g., on top of the real physical pedestal 312).

Figure 4:
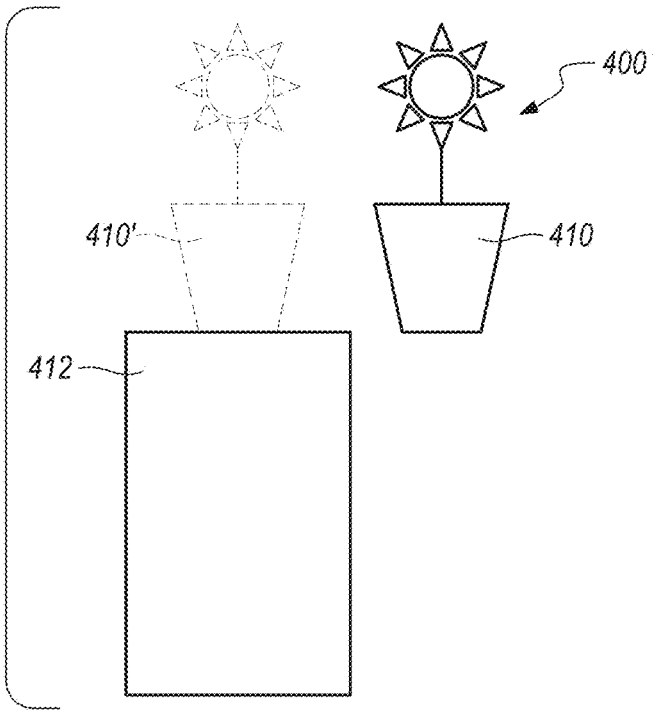

However, if the AR system's frame of reference changes (e.g., with rapid user head movement) in a gap between the first time at which the virtual flower pot 310 is rendered and the second time at which the rendered virtual flower pot 310 is displayed/projected, the mismatch/difference between the source frame of reference and the output frame of reference may result in visual artifacts/anomalies/glitches. For instance, FIG. 4 shows an AR scenario 400 including a virtual flower pot 410 that was rendered to be positioned on top of a real physical pedestal 412. However, because the AR system was rapidly moved to the right after the virtual flower pot 410 was rendered but before it was displayed/projected, the virtual flower pot 410 is displayed to the right of its intended position 410' (shown in phantom). As such, the virtual flower pot 410 appears to be floating in midair to the right of the real physical pedestal 412. This artifact will be remedied when the virtual flower pot is re-rendered in the output frame of reference (assuming that the AR system motion ceases). However, the artifact will still be visible to some users with the virtual flower pot 410 appearing to glitch by temporarily jumping to an unexpected position. This glitch and others like it can have a deleterious effect on the illusion of continuity of an AR scenario.

Some optical systems may include a warping system that warps or transforms the frame of reference of source virtual content from the source frame of reference in which the virtual content was generated to the output frame of reference in which the virtual content will be displayed. In the example depicted in FIG. 4, the AR system can detect and/or predict (e.g., using IMUs or eye tracking) the output frame of reference and/or pose. The AR system can then warp or transform the rendered virtual content from the source frame of reference into warped virtual content in the output frame of reference.

Color Virtual Content Warping Systems and Methods

Figure 5:
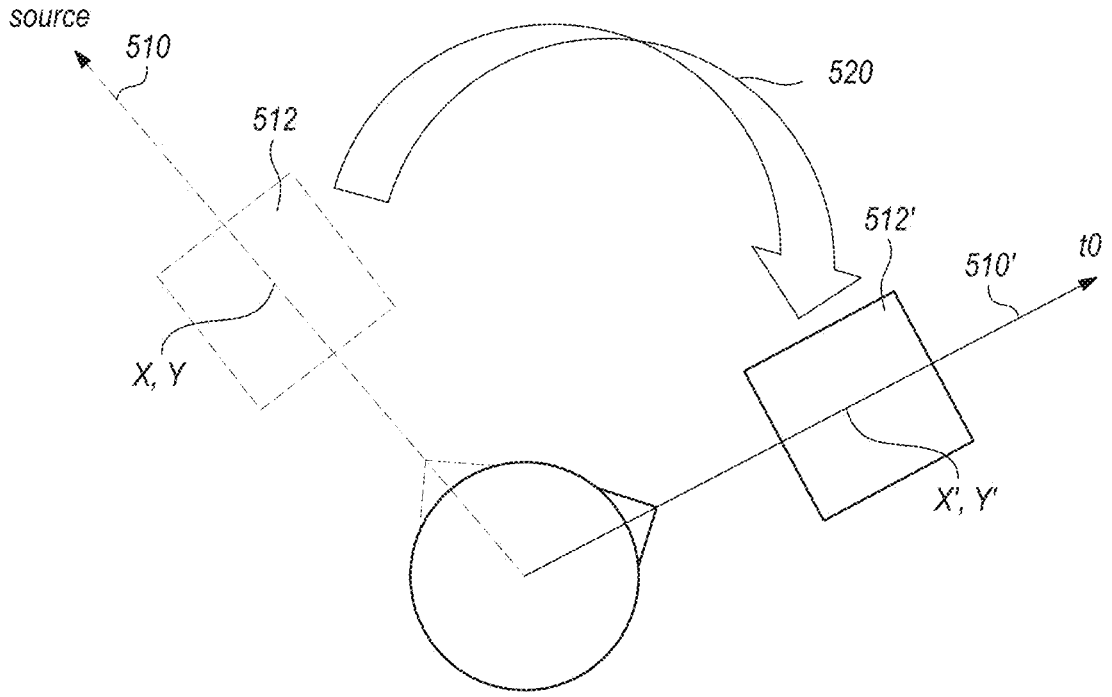
FIG. 5 illustrates an exemplary virtual content warp, according to some embodiments.

FIG. 5 schematically illustrates warping of virtual content, according to some embodiments. Source virtual content 512 in a source frame of reference (render pose) represented by ray 510, is warped into warped virtual content 512' in an output frame of reference (estimated pose) represented by ray 510'. The warp depicted in FIG. 5 may represent a head rotation to the right 520. While the source virtual content 512 is disposed at source X, Y location, the warped virtual content 512' is transformed to output X', Y' location.

Figure 6:
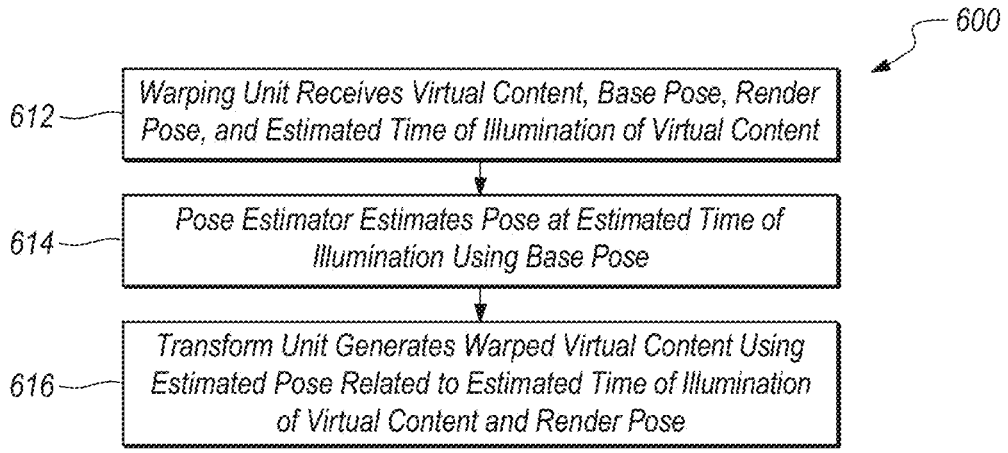
FIG. 6 depicts a method of warping virtual content as illustrated in FIG. 5, according to some embodiments.

FIG. 6 depicts a method of warping virtual content, according to some embodiments. At step 612, the warping unit 280 receives virtual content, a base pose (i.e., a current pose (current frame of reference) of the AR system 200, 200'), a render pose (i.e., a pose of the AR system 200, 200' used to render the virtual content (source frame of reference)), and an estimated time of illumination (i.e., estimated time at which the display system 204 will be illuminated (estimated output frame of reference)). In some embodiments, the base pose may be newer/more recent/more up-to-date than the render pose. At step 614, a pose estimator 282 estimates a pose at estimated time of illumination using the base pose and information about the AR system 200, 200'. At step 616, a transform unit 284 generates warped virtual content from the received virtual content using the estimated pose (from the estimated time of illumination) and the render pose.

When the virtual content includes color, some warping systems warp all of color sub-images or fields corresponding to/forming a color image using a single X', Y' location in a single output frame of reference (e.g., a single estimated pose from a single estimated time of illumination). However, some projection display systems (e.g., sequential projection display systems), like those in some AR systems, do not project all of the color sub-images/fields at the same time. For example, there may be some lag between projection of each color sub-image/fields. This lag between the projection of each color sub-images/fields, that is the difference in time of illumination, may result in color fringing artifacts in the final image during rapid head movement.

Figure 7A:
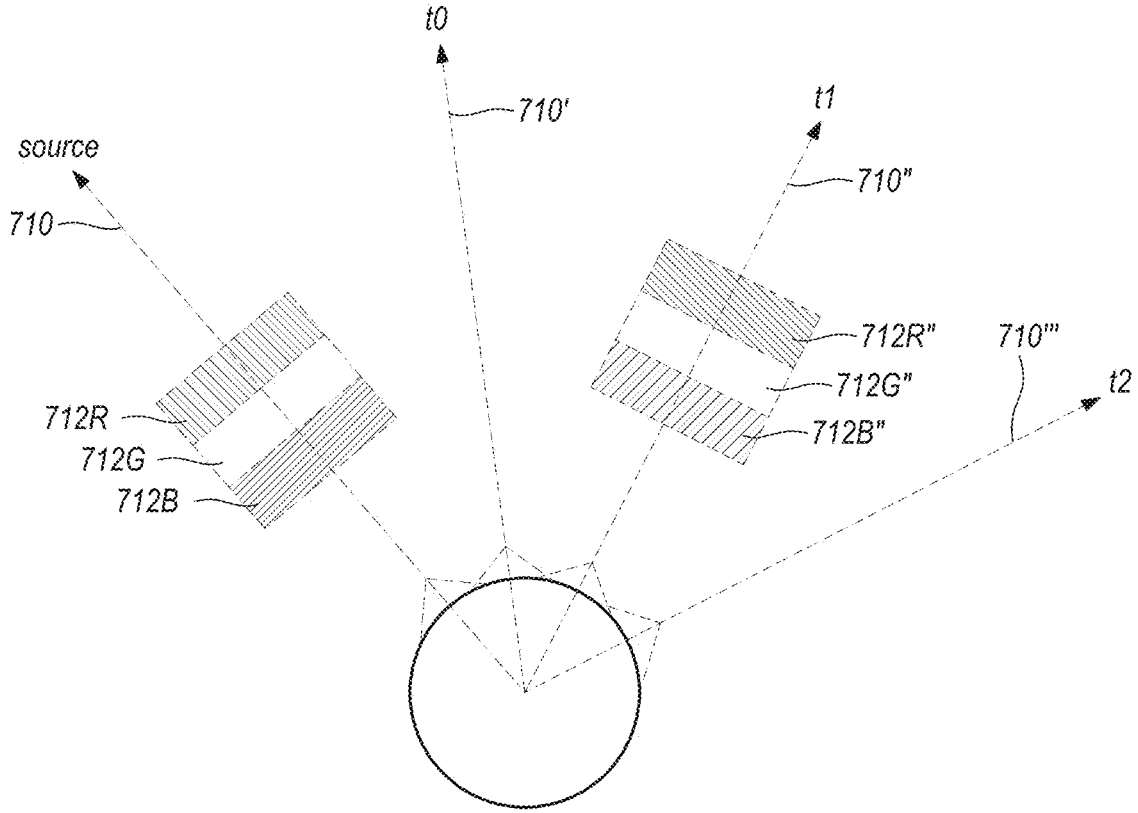
FIGS. 7A and 7B depict a multi-field (color) virtual content warp and the result thereof, according to some embodiments.

For instance, FIG. 7A schematically illustrates the warping of color virtual content using some warping systems, according to some embodiments. The source virtual content 712 has three color sections: a red section 712R; a green section 712G; and a blue section 712B. In this example, each color section corresponds to a color sub-image/field 712R", 712G", 712B". Some warping systems use a single output frame of reference (e.g., estimate pose) represented by ray 710" (e.g., the frame of reference 710" corresponding to the green sub-image and its time of illumination t1) to warp all three color sub-images 712R", 712G", 712B". However, some projection systems do not project the color sub-images 712R", 712G", 712B" at the same time. Instead, the color sub-images 712R", 712G", 712B" are projected at three slightly different times (represented by rays 710', 710", 710'" at times t0, t1, and t2). The size of the lag between projection of sub-images may depend on a frame/refresh rate of the projection system. For example, if the projection system has a frame rate of 60 Hz or below (e.g., 30 Hz), the lag can result in color fringing artifacts with fast moving viewers or objects.

Figure 7B:
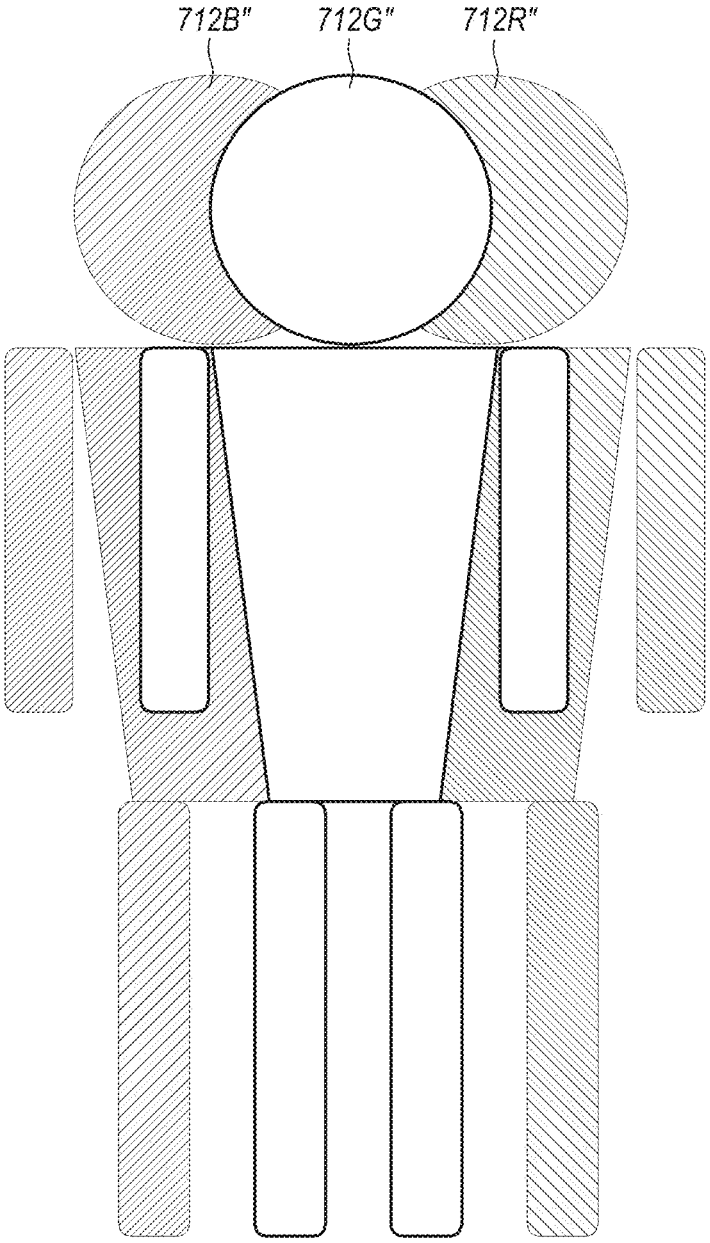

FIG. 7B illustrates color fringing artifacts generated by a virtual content warping system/method similar to the one depicted in FIG. 7A, according to some embodiments. Because the red sub-image 712R" is warped using the output frame of reference (e.g., estimate pose) represented by ray 710" in FIG. 7A, but projected at time t0 represented by ray 710', the red sub-image 712R" appears to overshoot the intended warp. This overshoot manifests as a right fringe image 712R" in FIG. 7B. Because the green sub-image 712G" is warped using the output frame of reference (e.g., estimated pose) represented by ray 710" in FIG. 7A, and projected at time t1 represented by ray 710", the green sub-image 712G" is projected with the intended warp. This is represented by the center image 712G" in FIG. 7B. Because the blue sub-image 712B" is warped using the output frame of reference (e.g., estimated pose) represented by ray 710" in FIG. 7A, but projected at time t2 represented by ray 710'", the blue sub-image 712B" appears to undershoot the intended warp. This undershoot manifests as a left fringe image 712B" in FIG. 7B. FIG. 7B illustrates the reconstruction of warped virtual content including a body having three overlapping R, G, B color fields (i.e., a body rendered in color) in a user's mind. FIG. 7B includes a red right fringe image color break up ("CBU") artifact 712R", a center image 712G", and a blue left fringe image CBU artifact 712B".

FIG. 7B exaggerates the overshoot and undershoot effects for illustrative purposes. The size of these effects depends on the frame/field rate of the projection system and the relative speeds of the virtual content and the output frame of reference (e.g., estimated pose). When these overshoot and undershoot effects are smaller, they may appear as color/rainbow fringes. For example, at slow enough frame rates, a white virtual object, such as a baseball, may have color (e.g., red, green, and/or blue) fringes. Instead of having a fringe, virtual objects with select solid colors matching a sub-image (e.g., red, green, and/or blue) may glitch (i.e., appear to jump to an unexpected position during rapid movement and jump back to an expected position after rapid movement). Such solid color virtual objects may also appear to vibrate during rapid movement.

Figure 8:
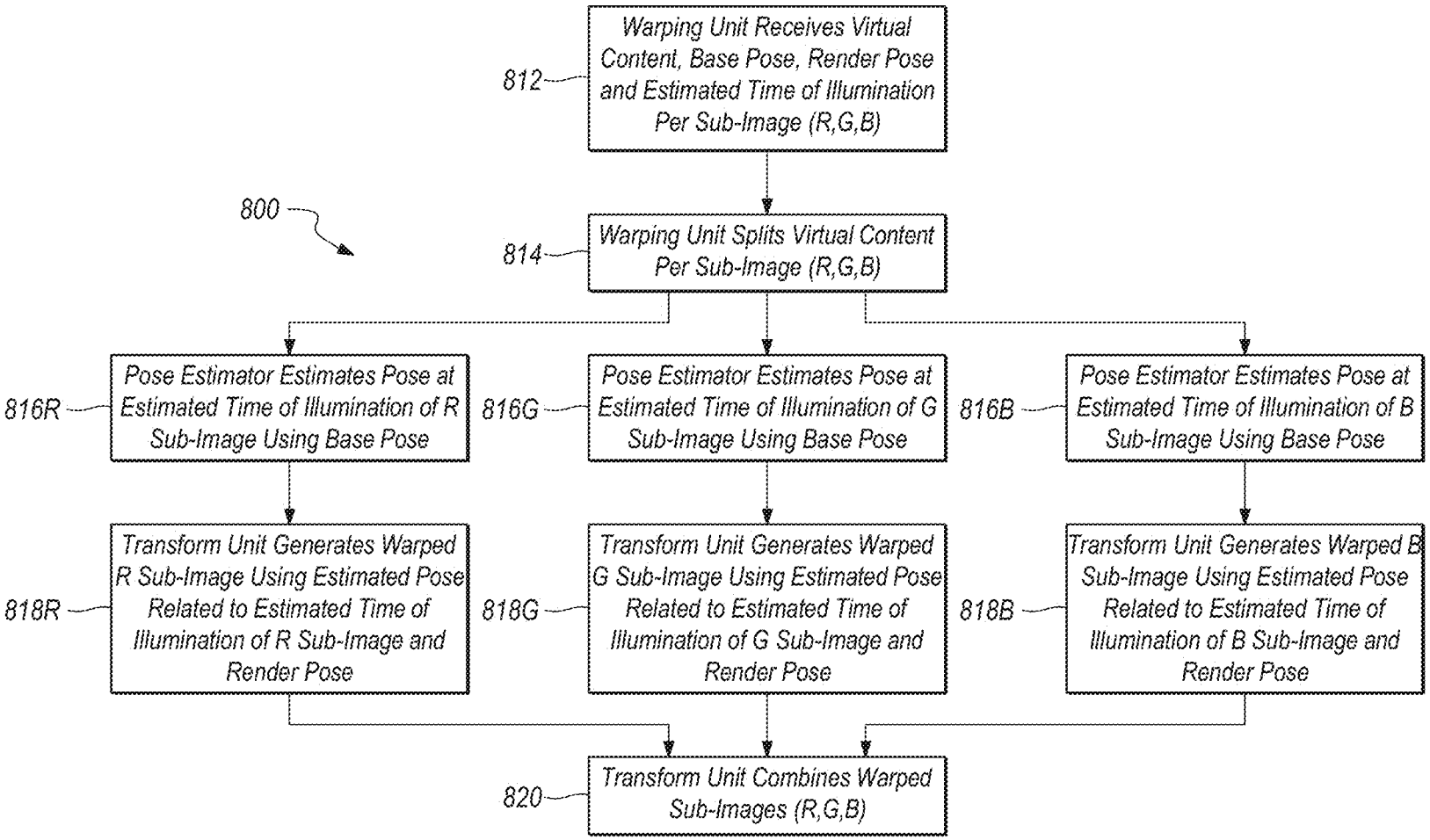
FIG. 8 depicts a method of warping multi-field (color) virtual content, according to some embodiments.

In order to address these limitations and others, the systems described herein warp color virtual content using a number of frames of reference corresponding to the number of color sub-images/fields. For example, FIG. 8 depicts a method of warping coloring virtual content, according to some embodiment. At step 812, a warping unit 280 receives virtual content, a base pose (i.e., a current pose (current frame of reference) of the AR system 200, 200'), a render pose (i.e., a pose of the AR system 200, 200' used to render the virtual content (source frame of reference)), and estimated times of illumination per sub-image/color field (R, G, B) (i.e., estimated time at which the display system 204 be illuminated for each sub-image (estimated output frame of reference of each sub-image)) related to the display system 204. At step 814, the warping unit 280 splits the virtual content into each sub-image/color field (R, G, B).

At steps 816R, 816G, and 816B, a pose estimator 282 estimates a pose at respective estimated times of illumination for R, G, B sub-images/fields using the base pose (e.g., current frame of reference) and information about the AR system 200, 200'. At steps 818R, 818G, and 818B, a transform unit 284 generates R, G, and B warped virtual content from the received virtual content sub-image/color field (R, G, B) using respective estimated R, G, and B poses and the render pose (e.g., source frame of reference). At step 820, the transform unit 284 combines the warped R, G, B sub-images/fields for sequential display.

Figure 9A:
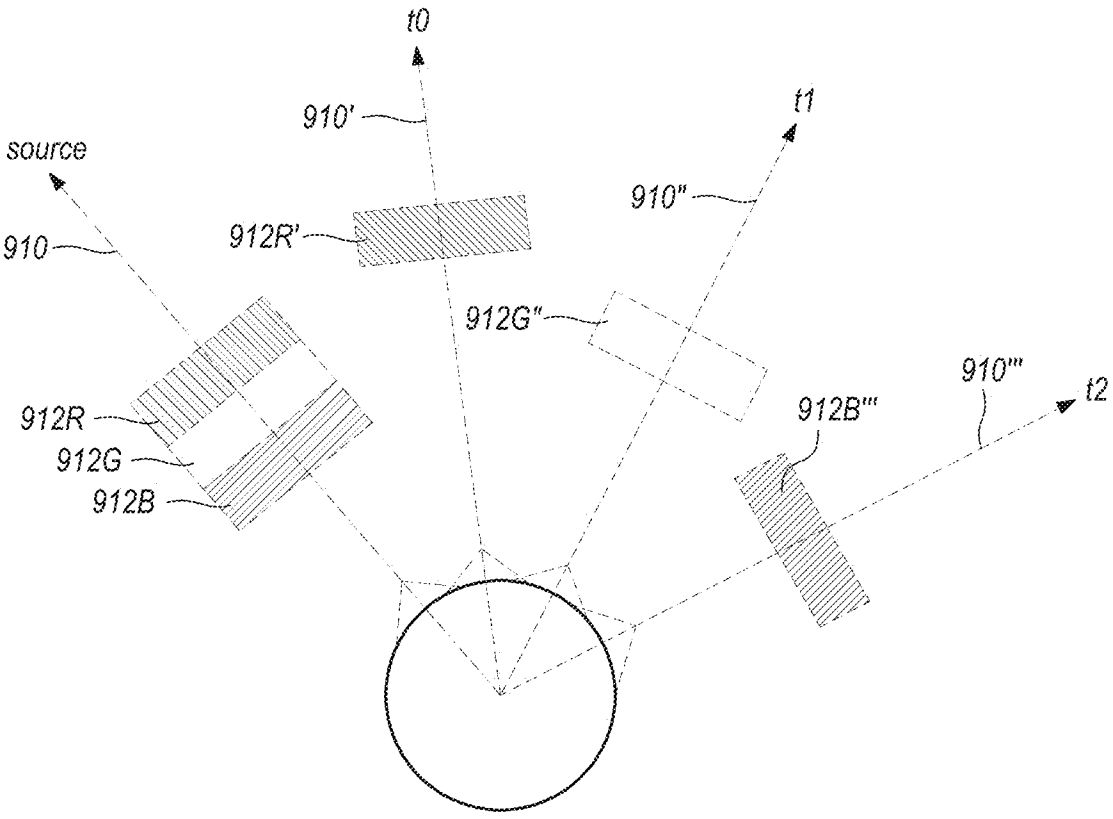
FIGS. 9A and 9B depict a multi-field (color) virtual content warp and the result thereof, according to some embodiments.

FIG. 9A schematically illustrates the warping of color virtual content using warping systems, according to some embodiments. Source virtual content 912 is identical to the source virtual content 712 in FIG. 7A. The source virtual content 912 has three color sections: a red section 912R; a green section 912G; and a blue section 912B. Each color section corresponds to a color sub-image/field 912R', 912G", 912B'". Warping systems according to the embodiments herein use respective output frames of reference (e.g., estimated poses) represented by rays 910', 910", 910'" to warp each corresponding color sub-image/field 912R', 912G", 912B'". These warping systems take the timing (i.e., t0, t1, t2) of projection of the color sub-images 912R', 912G", 912B'" into account when warping color virtual content. The timing of projection depends on the frame/field rate of the projection systems, which is used to calculate the timing of projection.

Figure 9B:
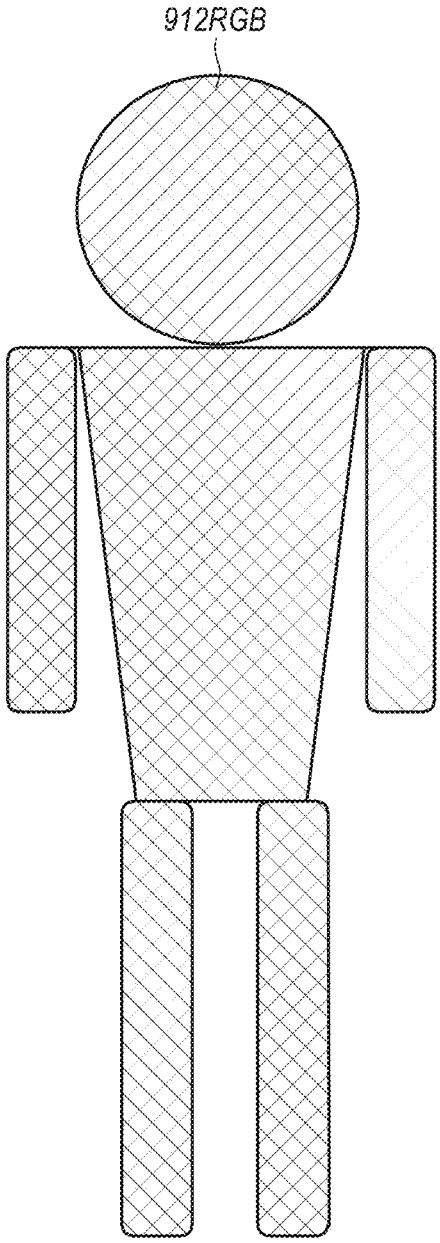

FIG. 9B illustrates a warped color sub-images 912R', 912G", 912B'" generated by the virtual content warping system/method similar to the one depicted in FIG. 9A. Because the red, green, and blue sub-images 912R', 912G", 912B'" are warped using respective output frames of reference (e.g., estimated poses) represented by rays 910', 910", 910'" and projected at times t0, t1, t2 represented by the same rays 910', 910", 910'", the sub-images 912R', 912G", 912B'" are projected with the intended warp. FIG. 9B illustrates the reconstruction of the warped virtual content according to some embodiments including a body having three overlapping R, G, B color fields (i.e., a body rendered in color) in a user's mind. FIG. 9B is a substantially accurate rendering of the body in color because the three sub-images/fields 912R', 912G", 912B'" are projected with the intended warp at the appropriate times.

The warping systems according to the embodiments herein warp the sub-images/fields 912R', 912G", 912B'" using the corresponding frames of reference (e.g., estimated poses) that take into account the timing of projection/time of illumination, instead of using a single frame of reference. Consequently, the warping systems according to the embodiments herein warp color virtual content into separate sub-images of different colors/fields while minimizing warp related color artifacts such as CBU. More accurate warping of color virtual content contributes to more realistic and believable AR scenarios.

Illustrative Graphics Processing Unit

Figure 10:
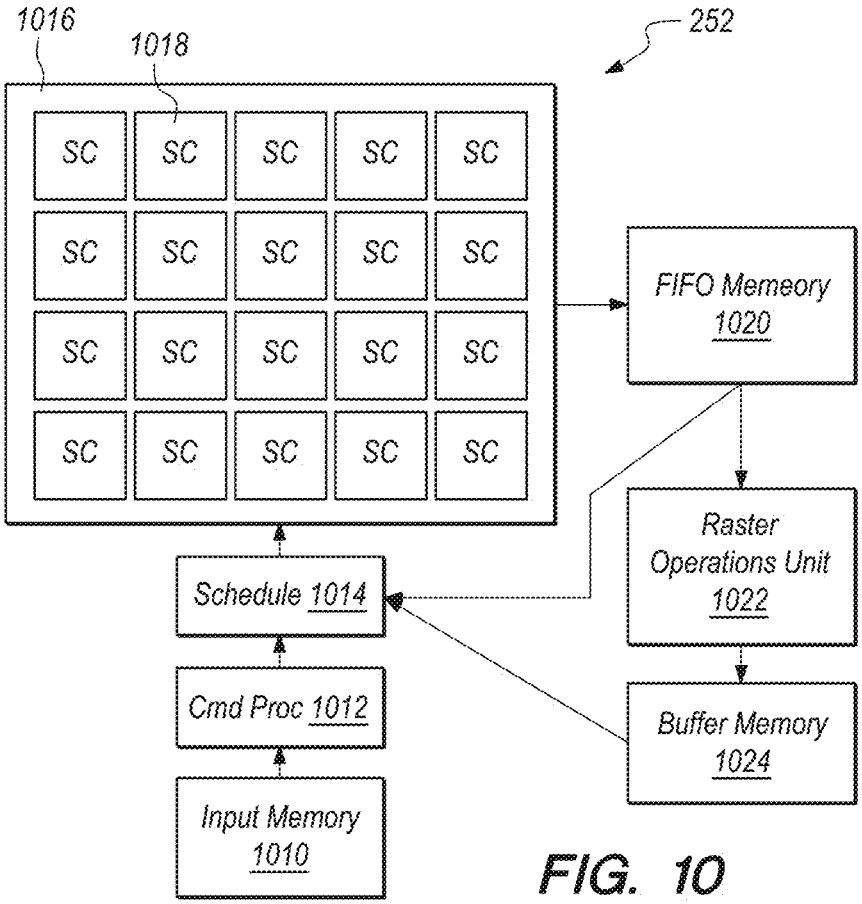
FIG. 10 schematically depicts a graphics processing unit (GPU), according to some embodiments.
Figure 11:
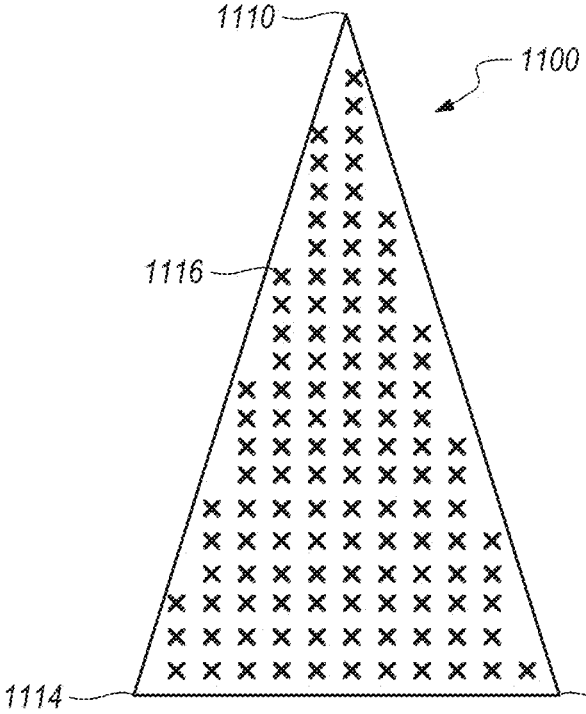
FIG. 11 depicts a virtual object stored as a primitive, according to some embodiments.

FIG. 10 schematically depicts an exemplary graphics processing unit (GPU) 252 to warp color virtual content to output frames of reference corresponding to various color sub-images or fields, according to one embodiment. The GPU 252 includes an input memory 1010 to store the generated color virtual content to be warped. In one embodiment, the color virtual content is stored as a primitive (e.g., a triangle 1100 in FIG. 11). The GPU 252 also includes a command processor 1012, which (1) receives/reads the color virtual content from input memory 1010, (2) divides the color virtual content into color sub-images and those color sub-images into scheduling units, and (3) sends the scheduling units along the rendering pipeline in waves or warps for parallel processing. The GPU 252 further includes a scheduler 1014 to receive the scheduling units from the command processor 1012. The scheduler 1014 also determines whether the "new work" from the command processor 1012 or "old work" returning from downstream in the rendering pipeline (described below) should be sent down the rendering pipeline at any particular time. In effect, the scheduler 1014 determines the sequence in which the GPU 252 processes various input data.

The GPU 252 includes a GPU core 1016, which has a number of parallel executable cores/units ("shader cores") 1018 for processing the scheduling units in parallel. The command processor 1012 divides the color virtual content into a number equal to the number of shader cores 1018 (e.g., 32). The GPU 252 also includes a "First In First Out" ("FIFO") memory 1020 to receive output from the GPU core 1016. From the FIFO memory 1020, the output may be routed back to the scheduler 1014 as "old work" for insertion into the rendering pipeline additional processing by the GPU core 1016.

The GPU 252 further includes a Raster Operations Unit ("ROP") 1022 that receives output from the FIFO memory 1020 and rasterizes the output for display. For instance, the primitives of the color virtual content may be stored as the coordinates of the vertices of triangles. After processing by the GPU core 1016 (during which the three vertices 1110, 1112, 1114 of a triangle 1100 may be warped), the ROP 1022 determines which pixels 1116 are inside of the triangle 1100 defined by three vertices 1110, 1112, 1114 and fills in those pixels 1116 in the color virtual content. The ROP 1022 may also perform depth testing on the color virtual content. For processing of color virtual content, the GPU 252 may include one or more ROPs 1022R, 1022B, 1022G for parallel processing of sub-images of different primary colors.

The GPU 252 also includes a buffer memory 1024 for temporarily storing warped color virtual content from the ROP 1022. The warped color virtual content in the buffer memory 1024 may include brightness/color and depth information at one or more X, Y positions in a field of view in an output frame of reference. The output from the buffer memory 1024 may be routed back to the scheduler 1014 as "old work" for insertion into the rendering pipeline additional processing by the GPU core 1016, or for display in the corresponding pixels of the display system. Each fragment of color virtual content in the input memory 1010 is processed by the GPU core 1016 at least twice. The GPU cores 1016 first processes the vertices 1110, 1112, 1114 of the triangles 1100, then it processes the pixels 1116 inside of the triangles 1100. When all the fragments of color virtual content in the input memory 1010 have been warped and depth tested (if necessary), the buffer memory 1024 will include all of the brightness/color and depth information needed to display a field of view in an output frame of reference.

Color Virtual Content Warping Systems and Methods

In standard image processing without head pose changes, the results of the processing by the GPU 252 are color/brightness values and depth values at respective X, Y values (e.g., at each pixel). However with head pose changes, virtual content is warped to conform to the head pose changes. With color virtual content, each color sub-image is warped separately. In existing methods for warping color virtual content, color sub-images corresponding to a color image are warped using a single output frame of reference (e.g., corresponding to the green sub-image). As described above, this may result in color fringing and other visual artifacts such as CBU.

Figure 12:
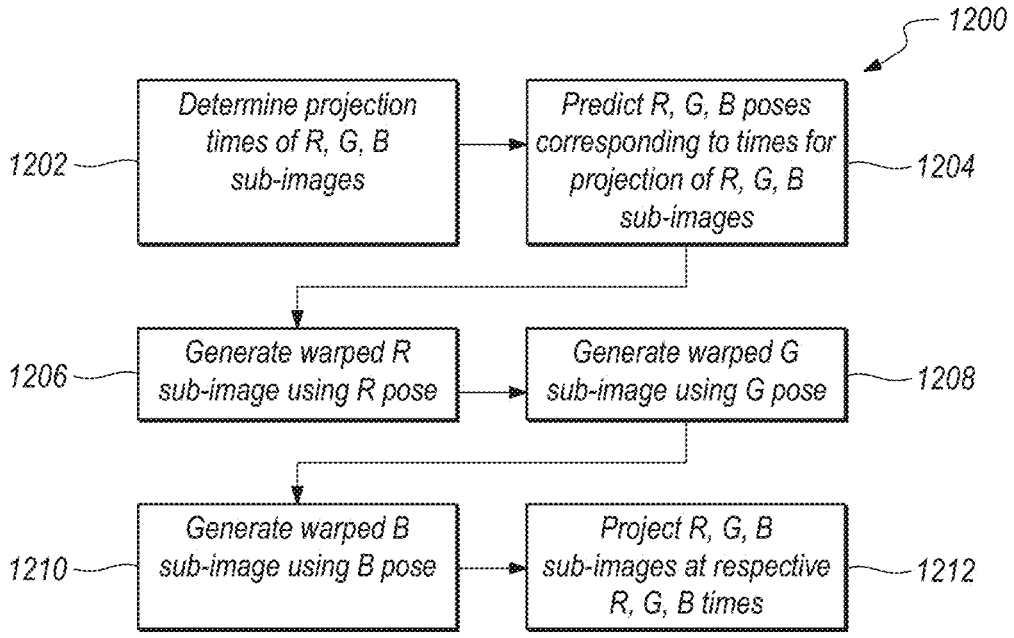
FIG. 12 depicts a method of warping multi-field (color) virtual content, according to some embodiments.

FIG. 12 depicts a method 1200 for warping color virtual content while minimizing visual artifacts such as CBU. At step 1202, a warping system (e.g., a GPU core 1016 and/or a warping unit 280 thereof) determines the projection/illumination times for the R, G, and B sub-images. This determination uses the frame rate and other characteristics of a related projection system. In the example in FIG. 9A, the projection times correspond to t0, t1, and t2 and rays 910', 910", 910'".

At step 1204, the warping system (e.g., the GPU core 1016 and/or the pose estimator 282 thereof) predicts poses/frames of reference corresponding to the projection times for the R, G, and B sub-images. This prediction uses various system input including current pose, system IMU velocity, and system IMU acceleration. In the example in FIG. 9A, the R, G, B poses/frames of reference correspond to rays t0, t1, and t2 and 910', 910", 910'".

At step 1206, the warping system (e.g., the GPU core 1016, the ROP 1022, and/or the transformation unit 284 thereof) warps the R sub-image using the R pose/frame of reference predicted at step 1204. At step 1208, the warping system (e.g., the GPU core 1016, the ROP 1022, and/or the transformation unit 284 thereof) warps the G sub-image using the G pose/frame of reference predicted at step 1204. At step 1210, the warping system (e.g., the GPU core 1016, the ROP 1022, and/or the transformation unit 284 thereof) warps the B sub-image using the B pose/frame of reference predicted at step 1204. Warping the separate sub-images/fields using the respective poses/frames of reference distinguishes these embodiments from existing methods for warping color virtual content.

At step 1212, a projection system operatively coupled to the warping system projects the R, G, B sub-images at the projection times for the R, G, and B sub-images determined in step 1202.

As described above, the method 1000 depicted in FIG. 10 may also be executed on a separate warping unit 280 that is independent from either any GPU 252 or CPU 251. In still another embodiment, the method 1000 depicted in FIG. 10 may be executed on a CPU 251. In yet other embodiments, the method 1000 depicted in FIG. 10 may be executed on various combinations/sub-combinations of GPU 252, CPU 251, and separate warping unit 280. The method 1000 depicted in FIG. 10 is an image processing pipeline that can be executed using various execution models according to system resource availability at a particular time.

Warping color virtual content using predicted poses/frames of reference corresponding to each color sub-image/field reduces color fringe and other visual anomalies. Reducing these anomalies results in a more realistic and immersive mixed reality scenario.

System Architecture Overview

Figure 13:
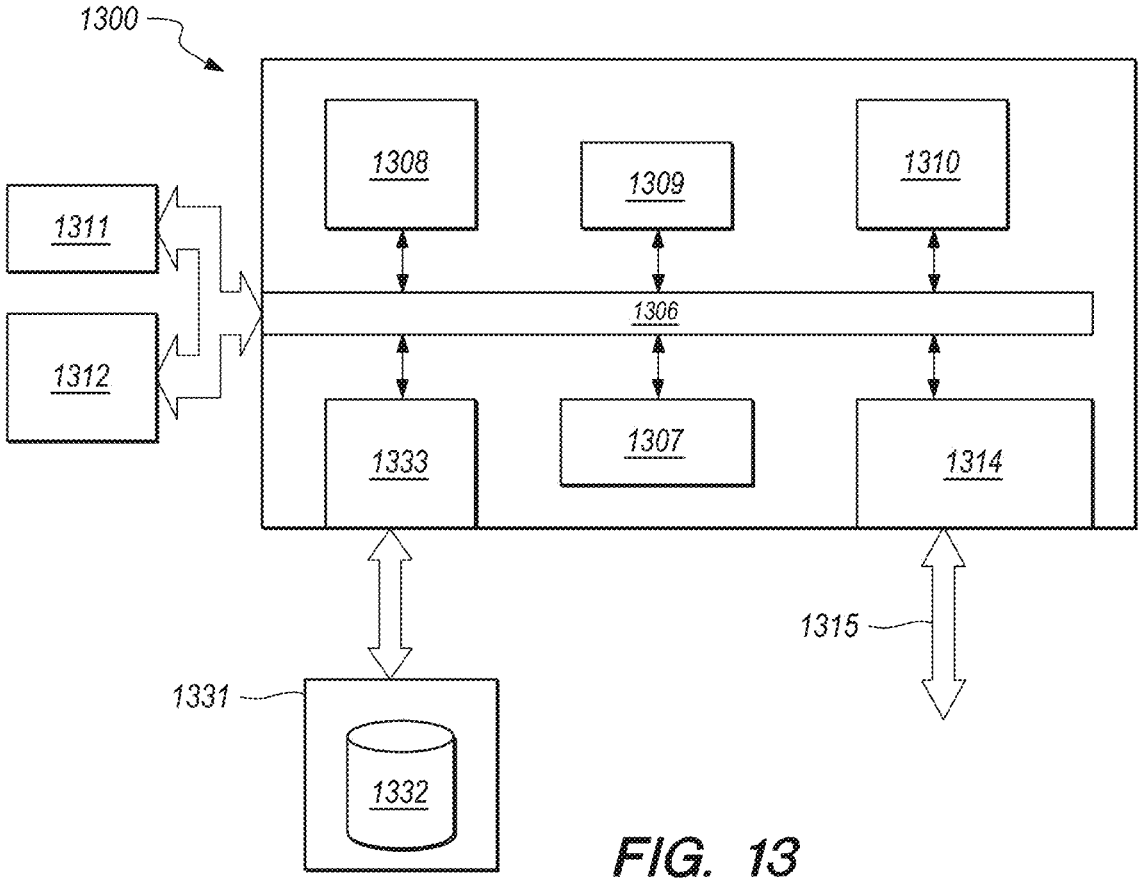
FIG. 13 is a block diagram schematically depicting an illustrative computing system, according to some embodiments.

FIG. 13 is a block diagram of an illustrative computing system 1300, according to some embodiments. Computer system 1300 includes a bus 1306 or other communication mechanism for communicating information, which interconnects subsystems and devices, such as processor 1307, system memory 1308 (e.g., RAM), static storage device 1309 (e.g., ROM), disk drive 1310 (e.g., magnetic or optical), communication interface 1314 (e.g., modem or Ethernet card), display 1311 (e.g., CRT or LCD), input device 1312 (e.g., keyboard), and cursor control.

According to some embodiments, computer system 1300 performs specific operations by processor 1307 executing one or more sequences of one or more instructions contained in system memory 1308. Such instructions may be read into system memory 1308 from another computer readable/usable medium, such as static storage device 1309 or disk drive 1310. In alternative embodiments, hard-wired circuitry may be used in place of or in combination with software instructions to implement the disclosure. Thus, embodiments are not limited to any specific combination of hardware circuitry and/or software. In one embodiment, the term "logic" shall mean any combination of software or hardware that is used to implement all or part of the disclosure.

The term "computer readable medium" or "computer usable medium" as used herein refers to any medium that participates in providing instructions to processor 1307 for execution. Such a medium may take many forms, including but not limited to, non-volatile media and volatile media. Non-volatile media includes, for example, optical or magnetic disks, such as disk drive 1310. Volatile media includes dynamic memory, such as system memory 1308.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM (e.g., NAND flash, NOR flash), any other memory chip or cartridge, or any other medium from which a computer can read.

In some embodiments, execution of the sequences of instructions to practice the disclosure is performed by a single computer system 1300. According to some embodiments, two or more computer systems 1300 coupled by communication link 1315 (e.g., LAN, PTSN, or wireless network) may perform the sequence of instructions required to practice the disclosure in coordination with one another.

Computer system 1300 may transmit and receive messages, data, and instructions, including program, i.e., application code, through communication link 1315 and communication interface 1314. Received program code may be executed by processor 1307 as it is received, and/or stored in disk drive 1310, or other non-volatile storage for later execution. Database 1332 in storage medium 1331 may be used to store data accessible by system 1300 via data interface 1333.

Alternative Warp/Render Pipeline

Figure 14:
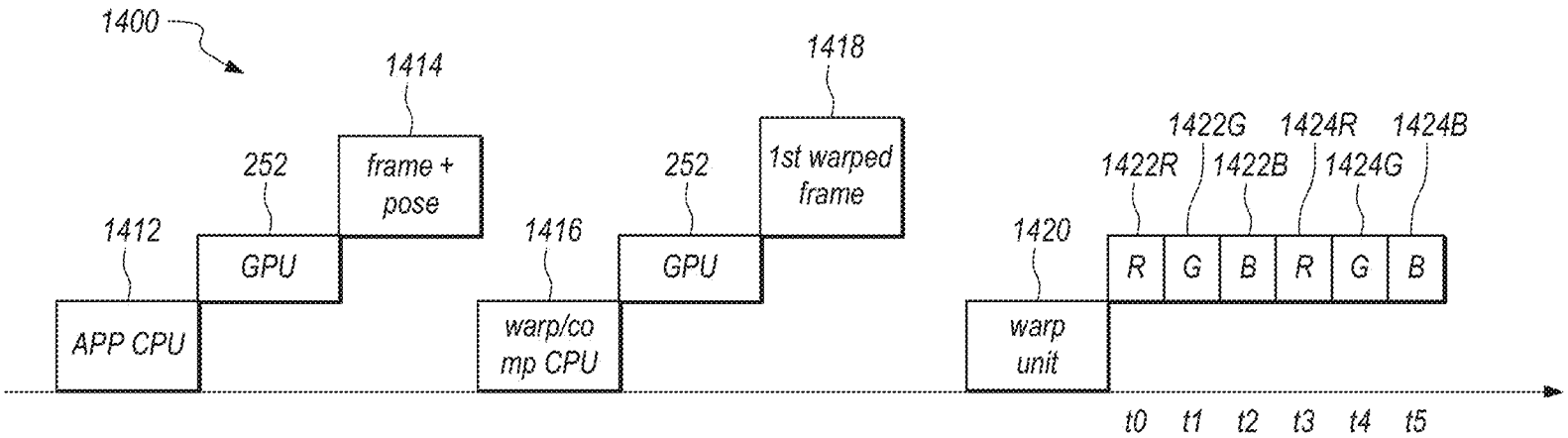
FIG. 14 depicts a warp/render pipeline for multi-field (color) virtual content, according to some embodiments.

FIG. 14 depicts a warp/render pipeline 1400 for multi-field (color) virtual content, according to some embodiments. The pipeline 1400 embodies two aspects: (1) multiple-stage/decoupled warping and (2) cadence variation between application frames and illumination frames.

(1) Multiple-Stage/Decoupled Warping

The pipeline 1400 includes one or more warping stages. At 1412, an application CPU ("client") generates virtual content, which is processed by an application GPU 252 to one or more (e.g., R, G, B) frames and poses 1414. At 1416, a warp/compositor CPU and its GPU 252 performs a first warp using a first estimated pose for each frame. Later in the pipeline 1400 (i.e., closer to illumination), a warp unit 1420 performs a second warp for each frame 1422R, 1422G, 1422B using a second estimated pose for each frame. The second estimated poses may be more accurate than the respective first estimated poses because the second estimated poses are determined closer to illumination. The twice warped frames 1422R, 1422G, 1422B are displayed at t0, t1, and t2.

The first warp may be a best guess that may be used to align the frames of virtual content for later warping. This may be a calculation intensive warp. The second warp may be a sequential corrective warp of respective once warped frames. The second warp may be a less calculation intensive warp to reduce the time between the second estimation of poses and display/illumination, thereby increasing accuracy.

(2) Cadence Variation

In some embodiments, cadences (i.e., frame rate) of the client or application and the display or illumination may not match. In some embodiments, an illumination frame rate may be twice an application frame rate. For instance, the illumination frame rate may be 60 Hz and the application frame rate may be 30 Hz.

In order to address warping issues with such a cadence mismatch, the pipeline 1400 generates two sets of twice warped frames 1422R, 1422G, 1422B (for projection at t0-t2) and 1424R, 1424G, 1424B (for projection at t3-t5) per frame 1414 from the application CPU 1412 and GPU 252. Using the same frame 1414 and first warped frame 1418, the warp unit 1420 sequentially generates first and second sets of twice warped frames 1422R, 1422G, 1422B and 1424R, 1424G, 1424B. This provides twice the number of warped frames 1422, 1424 per application frame 1414. The second warp may be a less calculation intensive warp to further reduce processor/power demand and heat generation.

While the pipeline 1400 depicts a 2:1 illumination/application ratio, that ratio may vary in other embodiments. For instance, the illumination/application ratio may be 3:1, 4:1, 2.5:1, and the like. In embodiments with fractional ratios, the most recently generated application frame 1414 may be used in the pipeline.

Alternative Color Break Up Minimizing Method

Figure 15:
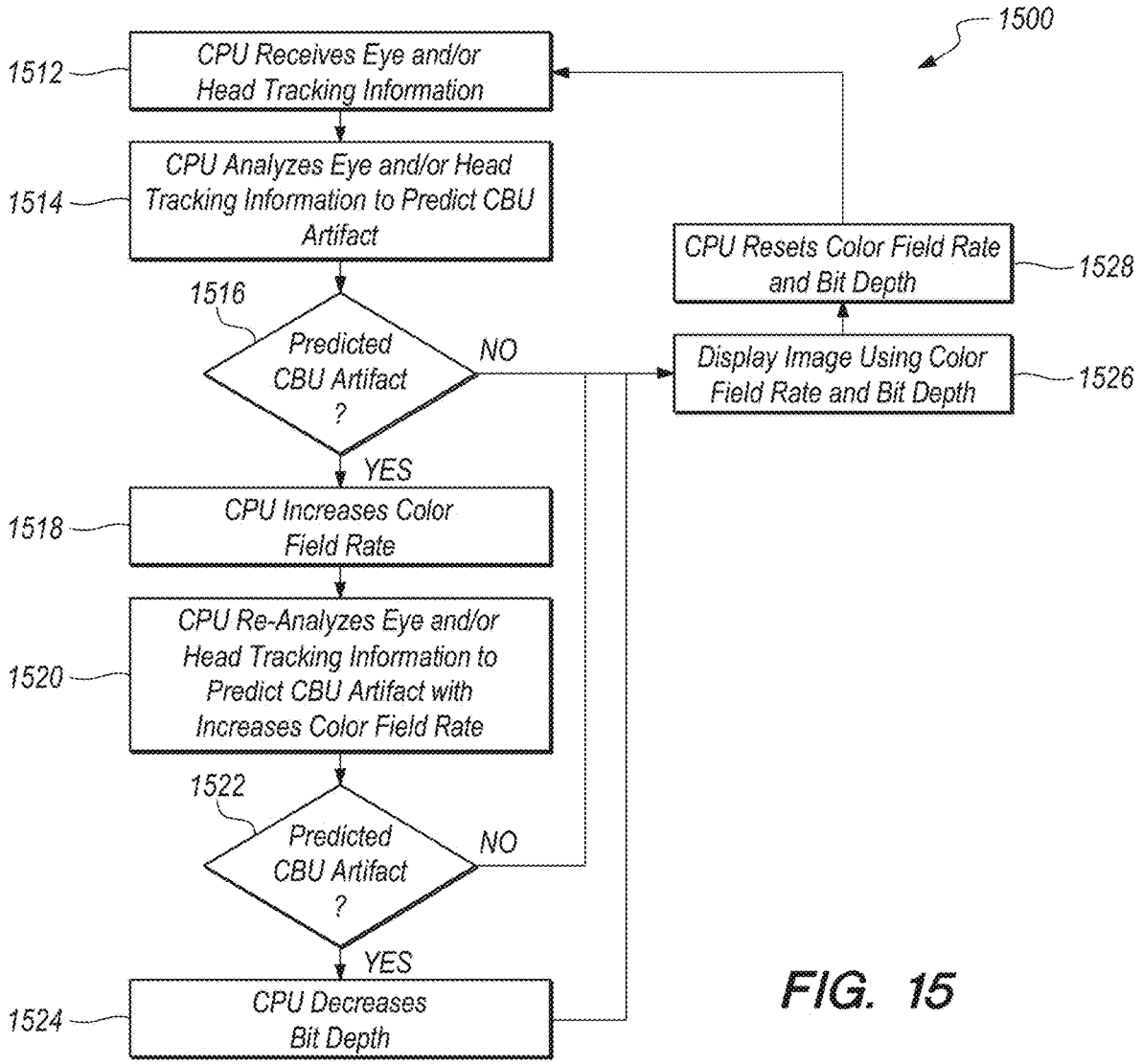
FIG. 15 depicts a method of minimizing Color Break Up artifact in warping multi-field (color) virtual content, according to some embodiments.

FIG. 15 depicts a method 1500 of minimizing color break up (CBU) artifact in warping multi-field (color) virtual content for a sequential display, according to some embodiments. At step 1512, a CPU receives eye and/or head tracking information (e.g., from eye tracking cameras or IMUs). At step 1514, the CPU analyzes the eye and/or head tracking information to predict a CBU artifact (e.g., based on characteristics of the display system). At step 1516, if CBU is predicted, the method 1500 proceeds to step 1518 where the CPU increases the color field rates (e.g., from 180 Hz to 360 Hz). At step 1516, if CBU is not predicted, the method 1500 proceeds to step 1526, where the image (e.g., split and warped field information) is displayed using the system default color field rate and bit depth (e.g., 180 Hz and 8 bits).

After increasing the color field rate at step 1518, the system re-analyzes the eye and/or head tracking information to predict a CBU artifact, at step 1520. At step 1522, if CBU is predicted, the method 1500 proceeds to step 1524 where the CPU decreases the bit depth (e.g., from 8 bit to 4 bit). After decreasing the bit depth, the image (e.g., split and warped field information) is displayed using the increased color field rate and the decreased bit depth (e.g., 360 Hz and 4 bits).

At step 1522, if CBU is not predicted, the method 1500 proceeds to step 1526, where the image (e.g., split and warped field information) is displayed using the increased color field rate and the system default bit depth (e.g., 180 Hz and 8 bits).

After the image (e.g., split and warped field information) is displayed using the adjusted or system default color field rate and bit depth, the CPU resets the color field rate and bit depth to the system default values at step 1528 before returning to step 1512 to repeat the method 1500.

By adjusting the color field rate and the bit depth in response to predicted CBU, the method 1500 depicted in FIG. 15 illustrates a method of minimizing CBU artifacts. The method 1500 may be combined with the other methods (e.g., method 800) described herein to further reduce CBU artifacts. While most of the steps in the method 1500 depicted in FIG. 15 are performed by the CPU, some or all of these steps can instead be performed by a GPU or dedicated component.

Figure 16A:
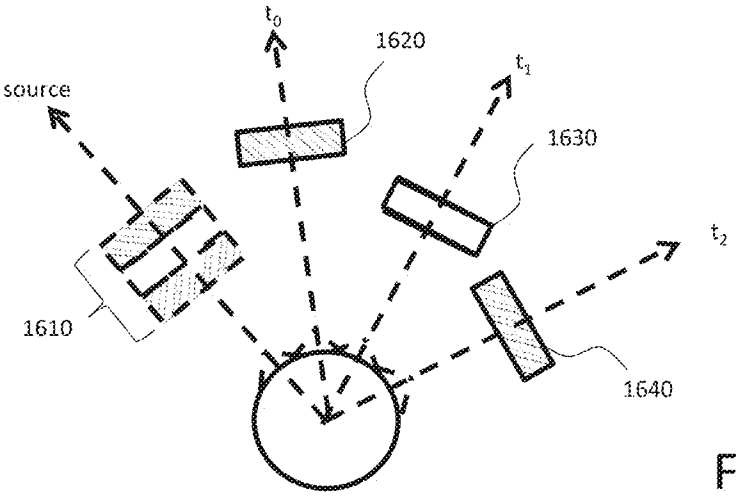
FIGS. 16A-B depict timing aspects of field sequential displays displaying uniform sub code bit depths per field as a function of head pose, according to some embodiments.

Color Virtual Content Warping using Intra-Field Sub Code Timing in Field Sequential Display Systems Referring now to FIG. 16A, an illustrative field sequential illumination sequence is shown relative to a change in head pose, according to some embodiments. As discussed in connection with FIG. 9A, the input image 1610 has three color sections: a red section; a green section; and a blue section. Each color section corresponds to a respective color sub-image/field 1620, 1630, 1640 of the input image 1610. In some embodiments, warping systems take into account the timing $t_0$, $t_1$ and $t_2$ of projection of the color fields when warping color virtual content.

In the red-green-blue (RGB) color system, various colors may be formed from the combination of the red, green and blue color fields. Each color may be represented using a code including an integer representing each one of red, green, and blue color fields. The red, green and blue colors may use 8 bits each, which have integer values from 0 to 255, corresponding to sub codes. For example, the red color may represented as (R=255, G=0, B=0), the green color may be represented as (0, 255, 0), and the blue color may be represented as (0, 0, 255). Various shades are formed by modifying the value of the integers representing the amount of the primary color fields (red, green, blue). This is discussed in greater detail below.

Figure 16B:
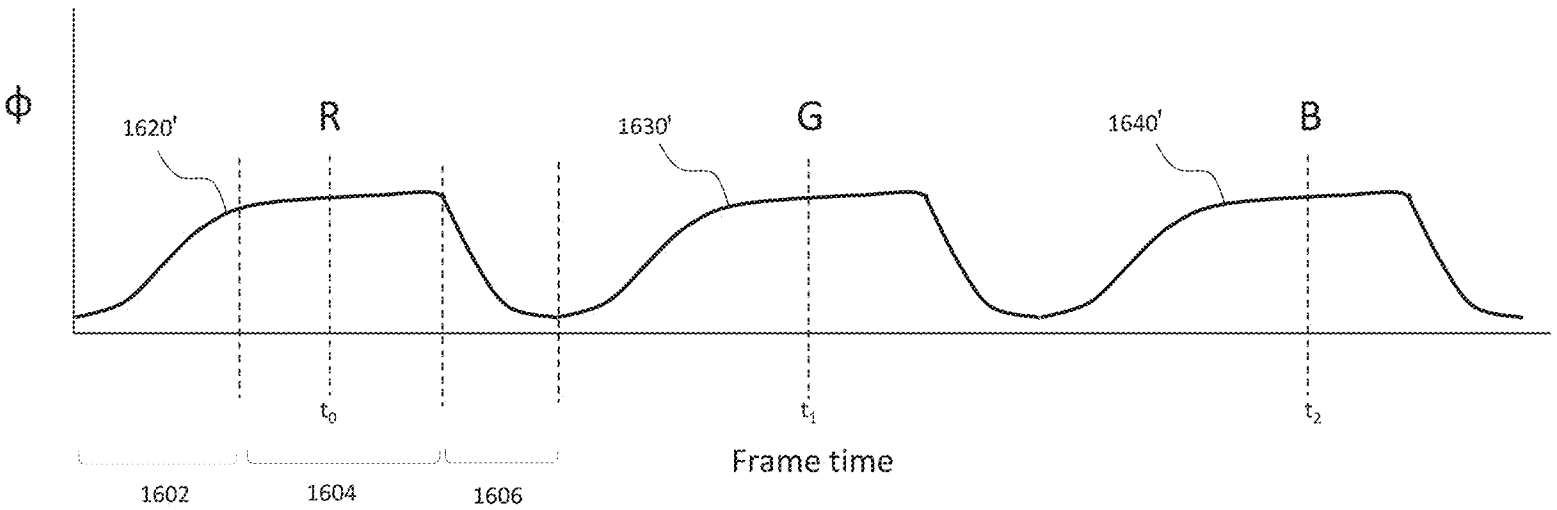

FIG. 16B shows a field bit depth pattern of a sigmoid growth-to-plateau-to-decay form for the full sub codes of each constituent color field. For example, for the red color field, the full sub codes include all colors with code (255, X, Y), where x and y can each take any value between 0 and 255. The sigmoid function (e.g., field bit depth pattern) 1620' corresponds to the full sub codes of red color field, the sigmoid function 1630' corresponds to the full sub code of green color field, and the sigmoid function 1640' corresponds to the full sub code of blue color field. As shown, each of the sigmoid functions 1620', 1630' and 1640' have a sigmoid growth segment 1602, a plateau segment 1604, and a decay segment 1606.

Given source input image 1610, as the user's head moves the color fields red, green, and blue should be displayed with appropriate warping corresponding to the given time that the respective field is located in the sequence. In some embodiments, for a given bit depth of a color field, timing is positioned at the centroid of that color field's display sequence allotted for that field. For example, the centroid of the red color field display sigmoid function 1620' is aligned with the head pose position at a first time ($t_0$), the centroid of the green color field display sigmoid function 1630' is aligned with the head pose position at a second time ($t_1$) later than the first time, and the centroid of the blue color field display sigmoid function 1640' is aligned with the head pose position at a third time ($t_2$) later than the first and second time.

Figure 17:
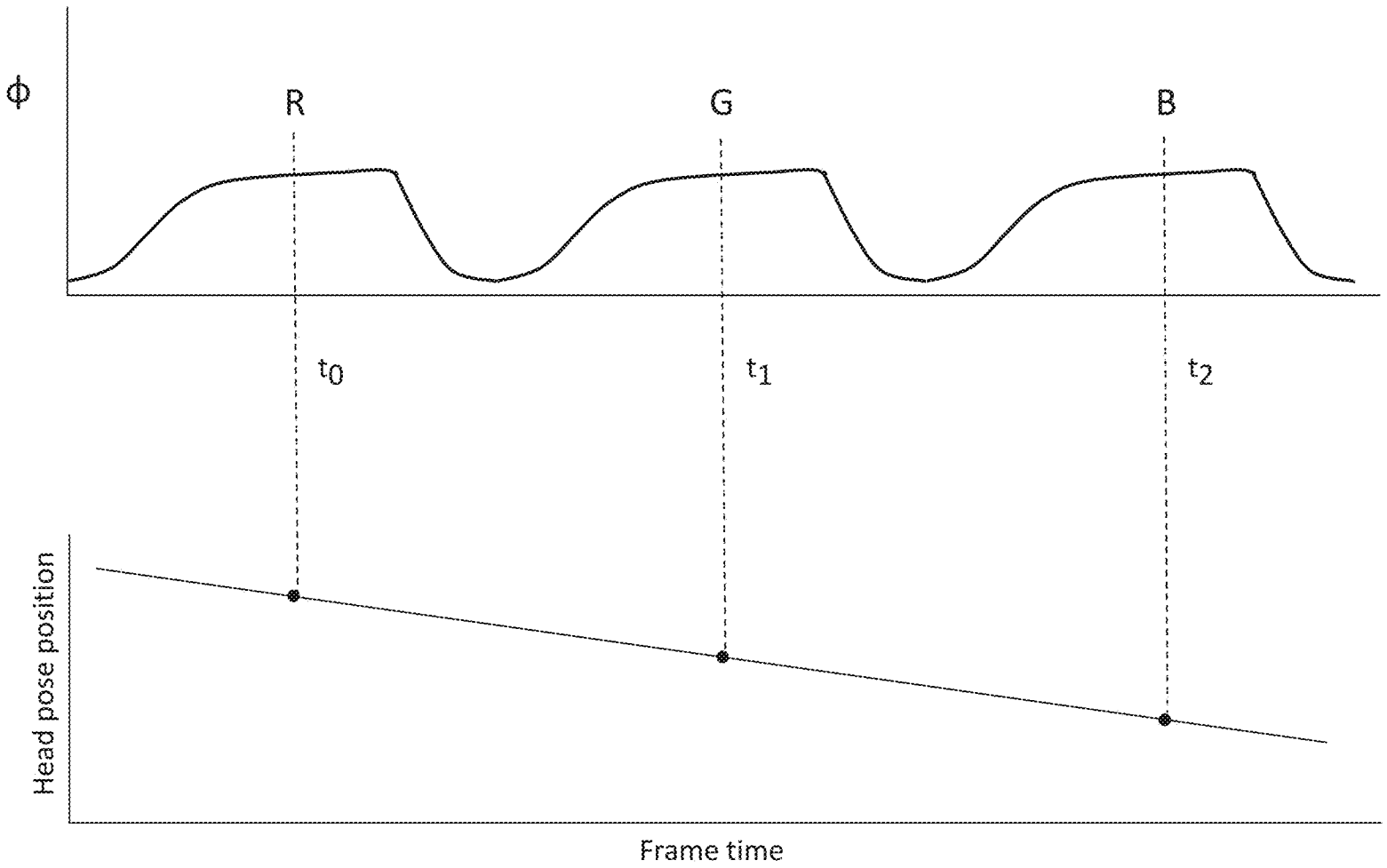
FIG. 17 depicts geometric positions of separate fields within field sequential displays, according to some embodiments.

FIG. 17 illustrates geometric relationships for the disparate timing sequences of the respective fields when undergoing head pose changes. Though the geometric positions for the red, green, and blue fields are offset from one another, the degree of change is consistent with the degree of change in head pose, presenting a more uniform image with overlapping fields at given pixels to produce a desired net color field.

FIGS. 16 and 17 each illustrate a field bit depth pattern of a sigmoid growth-to-plateau-to-decay form for the full sub code of the constituent color field.

Figure 18A:
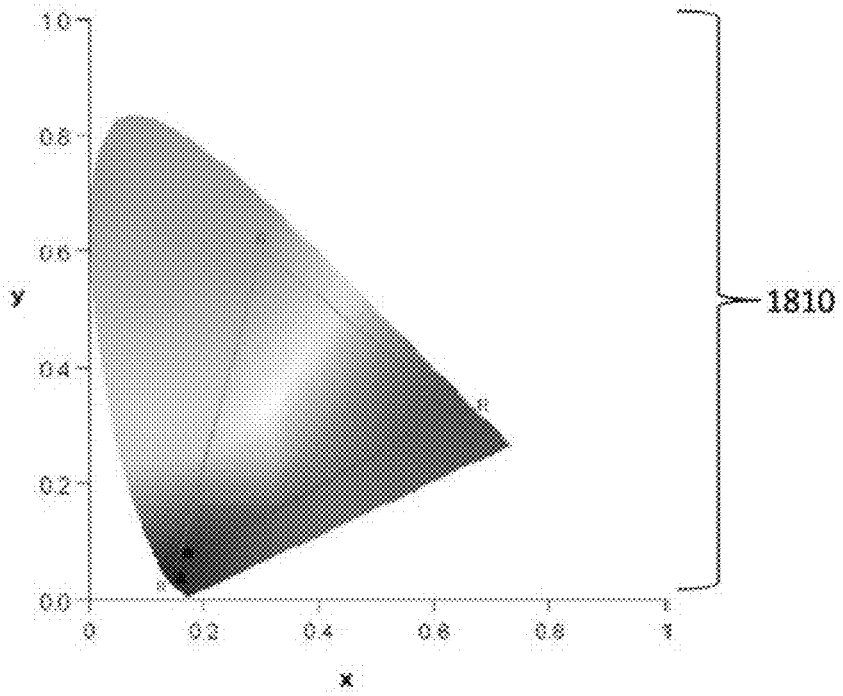
FIG. 18A depicts the commission internationale de l'éclairage (CIE) 1931 color scheme in gray scale.

It will be appreciated though, that colors are not simply created as a combination of equal constituent sub codes, and that various colors require different amounts of red, green and blue sub codes. For example, looking to the commission internationale de l'éclairage (CIE) 1931 color scheme, represented in gray scale by 1810 in FIG. 18A, any one color is a combination of multiple field inputs represented by sub codes. The sigmoid functions 1620', 1630' and 1640' of FIG. 16B represent the maximum potential of each field (e.g., (255, 0, 0) for the red color, (0, 255, 0) for the green color, (0, 0, 255) for the blue color—as sub coded by scheme 1810).

Specific colors may not share such uniform sub codes. For example, the color pink may have a combination of red 255, green 192, and blue 203 represented as (255, 192, 203); whereas the color orange may have a combination of red 255, green 165, and blue 0 represented as (255, 165, 0).

Figure 18B:
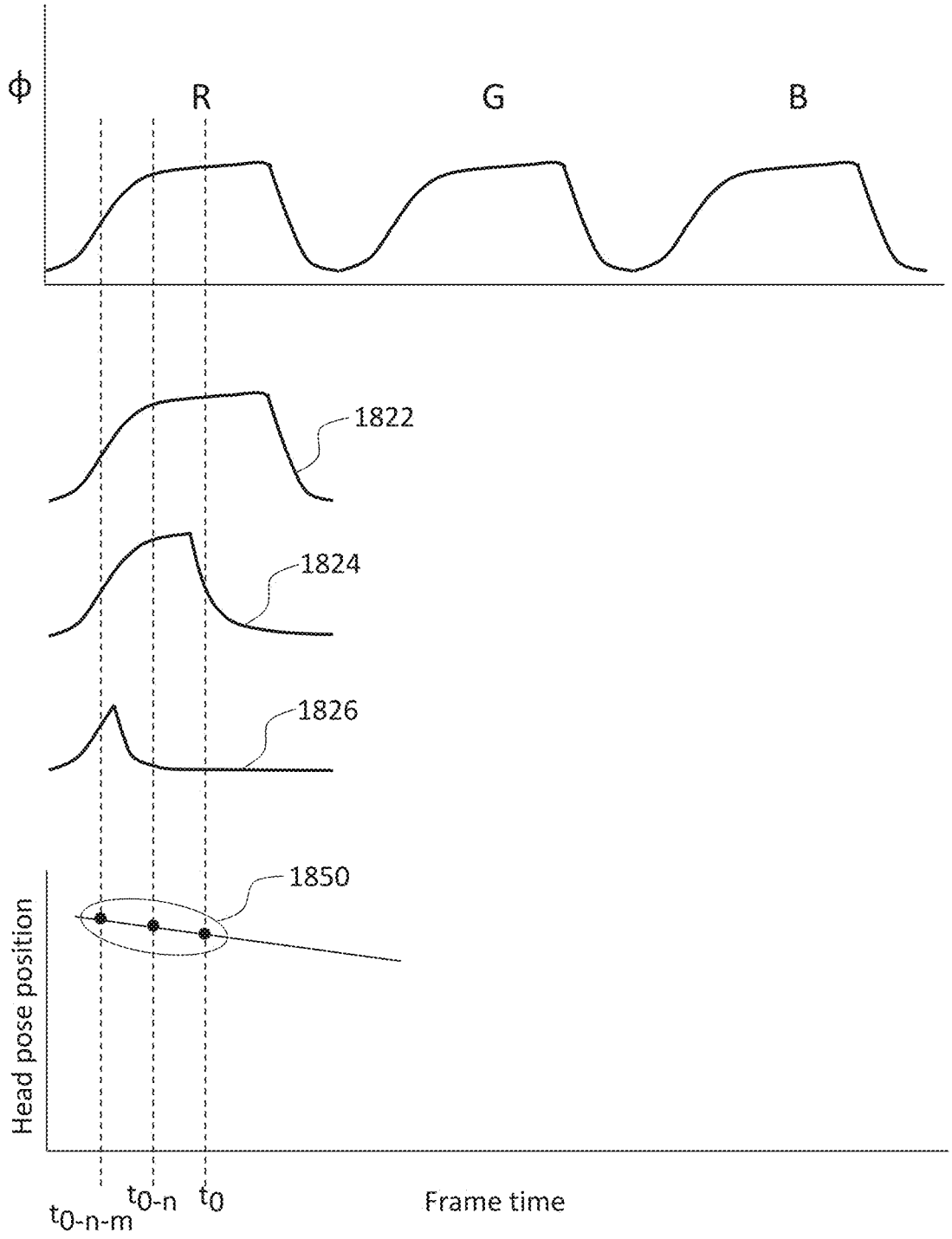
FIG. 18B depicts geometric timing aspects of disparate sub codes within a single field as a function of head pose, according to some embodiments.

A constituent color's sub code will correspondingly have a varying sigmoid form. Using the color field red as an exemplary set, various sub codes of red color field are illustrated in FIG. 18B by sigmoid functions 1822, 1824, and 1826, each sigmoid function corresponding to a different sub code. For example, the first sub code of red (e.g., (255, 10, 15)) represented by the sigmoid function 1822 may be the red color for the entire field time in the sequence, whereas the sigmoid functions 1824 and 1826 represent different sub codes (i.e., a second sub code (e.g., (255, 100, 100)) and a third sub code (e.g., (255, 150, 200)), respectively) of the red color corresponding to lesser times of activation of a given pixel under pulse of a spatial light modulator within the field time allotted in the sequence. Commonly in display technology, the start of the growth phase is common to any sub code, but the decay portion begins at disparate times. As such, a particular sigmoid pattern and a resultant centroid of any given sub code is shifted relative to one another when the sub codes are initiated at common start times of the field's timing in the sequence.

In conventional field sequential display systems, sub codes are initiated at common times, such that the centroids for the sub codes' sigmoids will offset from one another. As illustrated in FIG. 18B, the centroid for the first sub code of red represented by the sigmoid function 1822 appears at $t_0$, but the centroids for the second and third sub codes of red represented respectively by the sigmoid functions 1824 and 1826 appear at $t_{0-n}$ and $t_{0-n-m}$ respectively. Grouping 1850 shows the range of possible head pose positions that each sub code may need to be warped to for effective viewing during head motion of a head-mounted display device.

The different centroid times for sub codes within a single field (i.e., color) manifest as different positions when a user's head pose changes, which may result in intra-color separation despite any warping of that field that may otherwise occur as that warp will apply to an offset position for that sub code. In other words, a pixel that is intended to be pink may be geometrically offset from a pixel that is intended to be orange, because the timing of the head pose does not match the centroid pattern timing of the sub codes.

Figure 19:
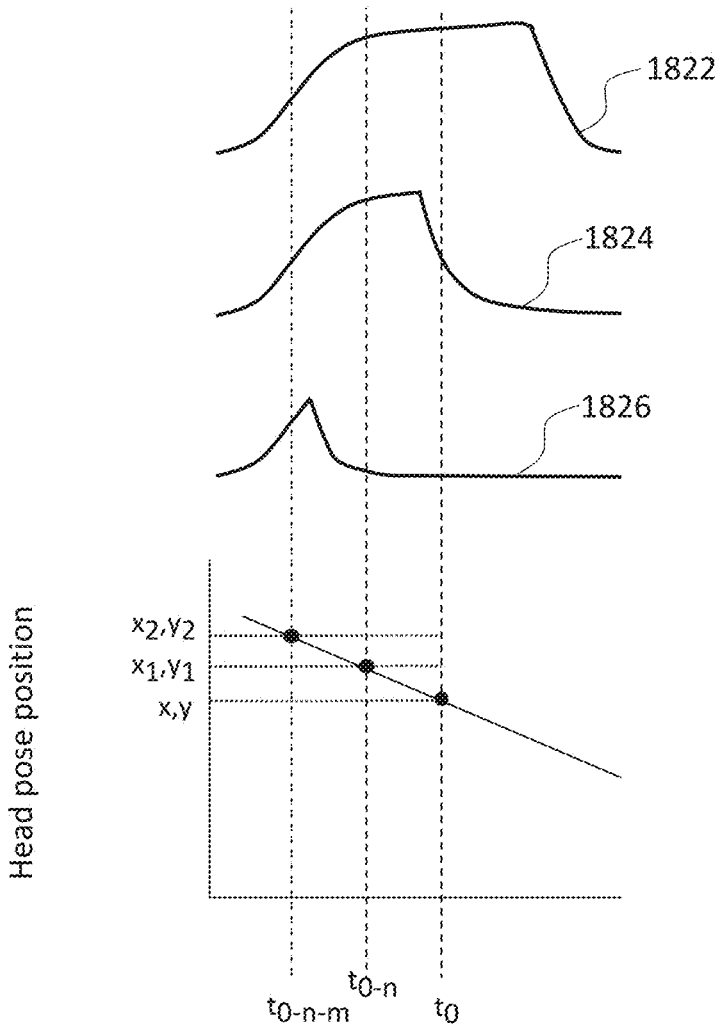
FIG. 19 depicts geometric positions of field sub codes within field sequential displays, according to some embodiments.

FIG. 19 more specifically illustrates this principle for a single field with various sub code possibilities, as the user's head position, at $t_0$ is at x,y which may correctly align with the first sub code represented by the sigmoid function 1822, but the particular centroids for the second and third sub codes represented respectively by the sigmoid functions 1824 and 1826 correspond in geometric space to $x_1,y_1$ and $x_2,y_2$. If a spatial light modulator carrying this image data were to activate at a common time $t_0$, the appearance of pixels conveying image data for the second and third sub codes represented respectively by the sigmoid functions 1824 and 1826 would appear offset from where they should appear. This problem is similarly compounded when extended for the green and blue color fields and their respective sub codes.

In some embodiments, this is corrected by having increasingly smaller head pose samples to permit any given color sub code having its sigmoid centroid timed for the given head pose. For example, a specific head pose for $t_{0-n-m}$ could be calculated and applied for the third sub code represented by the sigmoid function 1826, and a new specific head pose for $t_{0-n}$ could be calculated and applied for the second sub code represented by the sigmoid function 1824, and a specific head pose for $t_0$ could be calculated and applied for the first sub code represented by the sigmoid function 1822. For believable augmented reality perception, projector frequency is ideally faster than 120 Hz. For a field sequential display having three fields, this permits only milliseconds for any single head pose calculation. Sampling additional head poses for each of the hundreds of sub codes within each field may be prohibitively costly for computing power and desired form factor.

Figure 20:
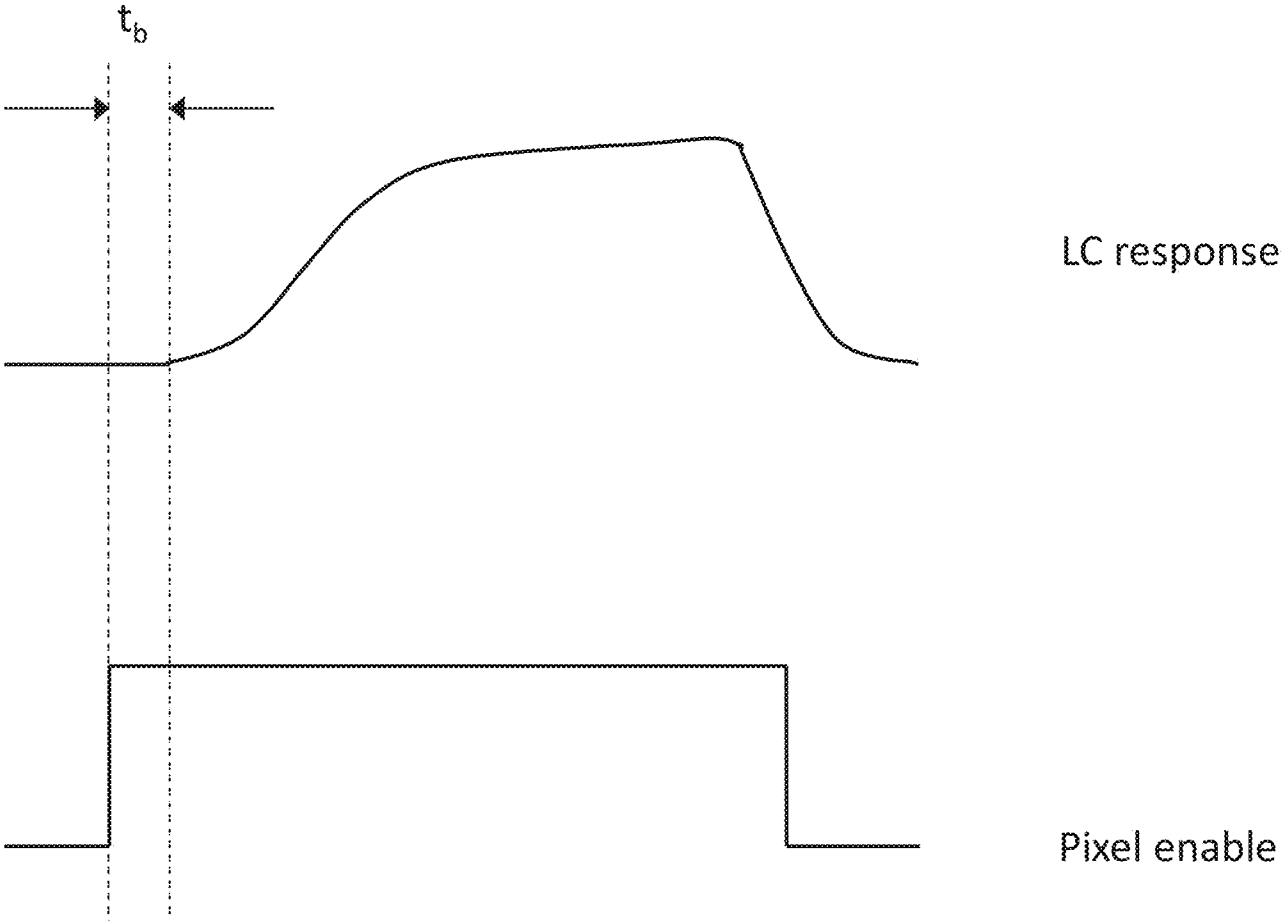
FIG. 20 depicts timing aspects related to pixel activation and liquid crystal displays, according to some embodiments.
Figure 21:
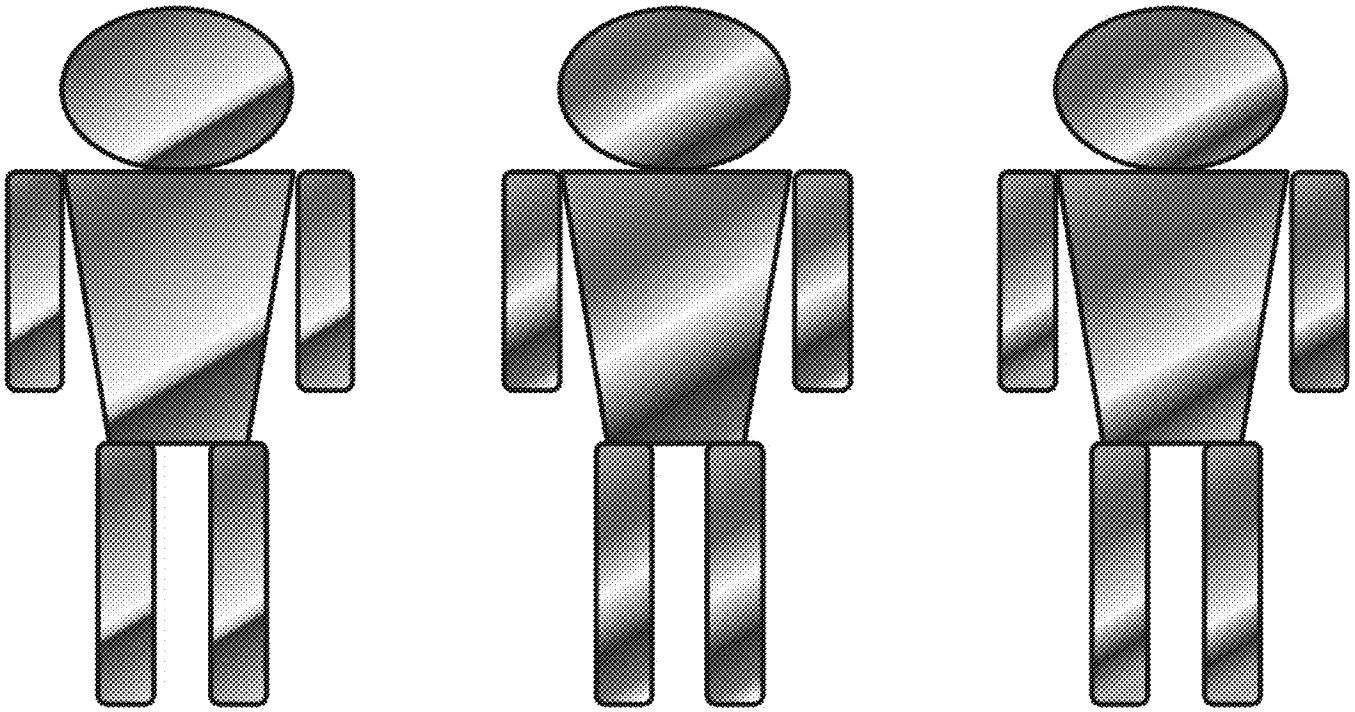
FIG. 21 depicts color contouring effects incident to timing of colors in field sequential displays.

According to some embodiments, the sigmoid function shape for a given sub code may be compounded. Various display systems and spatial light modulators employ mediums and components that do not instantly respond to inputs. FIG. 20 illustrates an exemplary lag that may occur in some systems. For example, for a liquid crystal on silicon (LCoS) display, when a given pixel may be activated, the given liquid crystal layer may induce a delay $t_b$ in initiating the sigmoid form. This lag may exacerbate any head pose changes already present with the sub codes as described above, or result in contouring of the image wherein a single color scheme's sub codes present bands across an image. FIG. 21 illustrates an exaggerated effect of such image contouring in a field sequential display prone to timing issues pixel enablement of sub codes when the display is moving.

Figure 22:
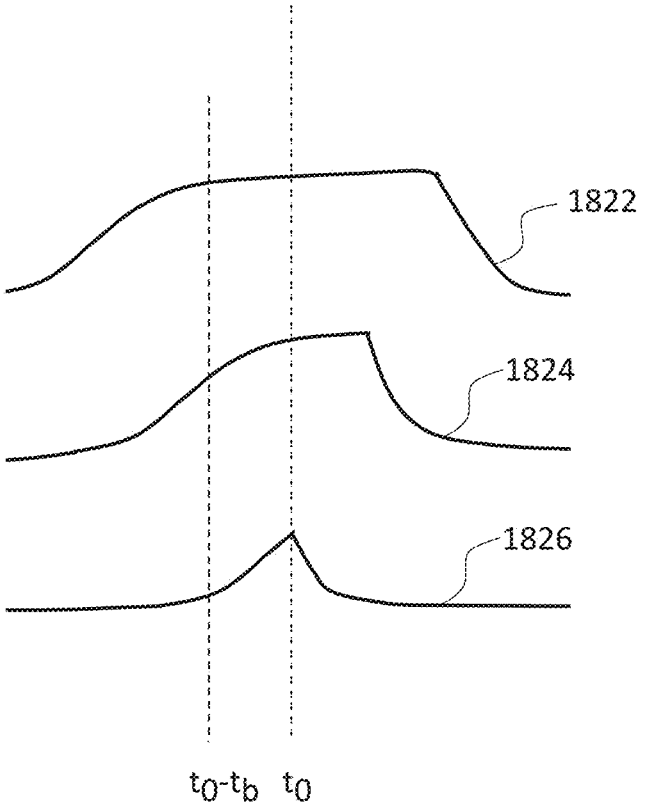
FIG. 22 depicts adjusting color sub codes to a common timing or a common temporal relationship, according to some embodiments.

To alleviate these timing concerns without sacrificing excessive computing power, in some embodiments the centroid for each sigmoid representing a sub code is temporally modified to correspond at a common head pose time for all sub codes of a common field. As depicted in FIG. 22, rather than initiating at a common source time, the sub-codes are initiated at different times to present their respective bit depth sigmoid centroids at a common time $t_0$. In some embodiments, the start times for a single or all sub codes is offset further such that the sigmoid is calculated to align at time $t_0-t_b$, as the pixel-to-response time will align with a common head pose measurement. In other words, the modulation and timing of every field input value (i.e., red, green, blue) to the spatial light modulator is constructed such that the centroids of output light for each sub code is the same within a field channel.

Figure 23:
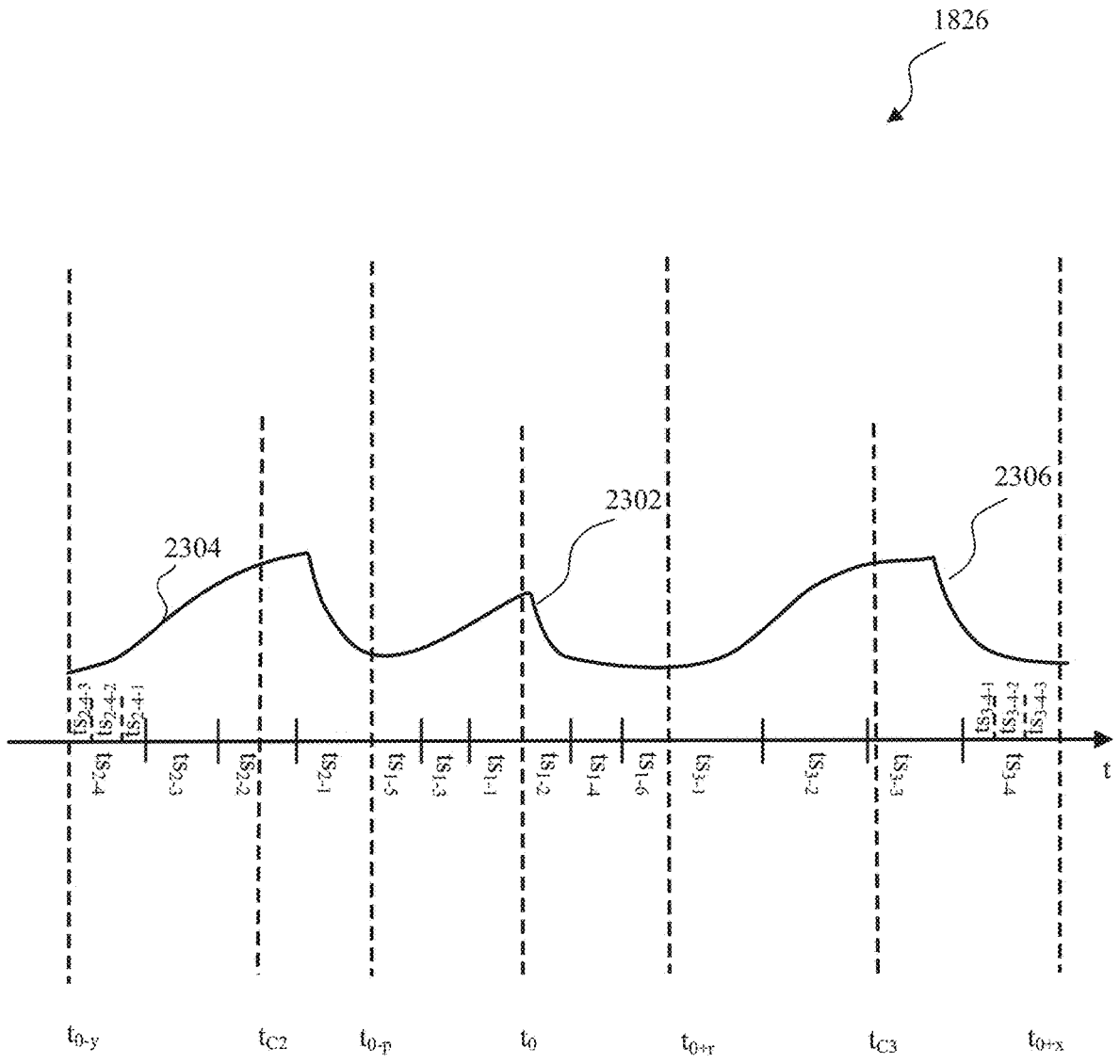
FIG. 23 depicts sequential pulsing to produce bit depths within a field based on a temporal center, according to some embodiments.

In some embodiments, rather than creating a single sub code input (such as the second sub code represented by the single sigmoid function 1826 of FIG. 22), a series of pulses create one or more per-field inputs. In FIG. 23, a central pulse 2302 is centered on a timing of a field within the frame of the sequential display ($t_0$). That is, the central pulse is centered at a time for projection of the warped color field (e.g., the time of the head pose sample used for warping the color field). A centroid of the pulse 2302 is at time $t_0$.

A second pulse 2304 (though occurring before than the central pulse 2302, this is referred to a second pulse as it is measured relative to the central pulse 2302, which may be referred to as the first pulse) is measured from the centroid of the center pulse 2302 at time $t_0$, to temporally align an end of the decay phase of the second pulse 2304 with a beginning of the growth phase of the central pulse 2302 at time $t_{0-p}$. A centroid of the second pulse 2304 is at time $t_{c2}$, which occurs a predetermined amount of time (e.g., $t_0-t_{c2}$ in FIG. 23) before (i.e., occurs in time prior to) the time $t_0$.

A third pulse 2306 (occurring after the central pulse 2302) is measured from the centroid of the center pulse 2302 at time $t_0$, to temporally align the beginning of the growth phase of the third pulse 2306 with an end of the decay phase of the central pulse 2302 at time $t_{0+r}$. A centroid of the third pulse 2306 is at time $t_{c3}$, which occurs a predetermined amount of time (e.g., $t_{c3}-t_0$ in FIG. 23) after (i.e., occurs in time later than) the time $t_0$.

In some embodiments, the difference between time $t_{c3}$ and time $t_0$ may be equal to the difference between time $t_0$ and time $t_{c2}$. That is, the centroid of the second pulse 2304 occurs before a predetermined amount of time from the centroid of the central pulse 2302, and the centroid of the third pulse 2306 occurs after the same predetermined amount of time from the centroid of the central pulse 2302. Such symmetry of centroids creates selective bit depth throughout the field's sequence with more even distribution about the head pose sample. For example, a single pulse for sub code of desired bit depth requires precise timing for the specific bit depth about the head pose time; a bit depth that is spread out with lower pulses for a cumulative bit depth around the head pose timing is less susceptible to color separation by changes in direction or variable speeds of head pose changes as only one of the one or more pulses will be temporally aligned with the head pose sample (e.g., the central pulse 2302).

As depicted in FIG. 23, the second pulse 2304 is appended to the central pulse 2302 at $t_{0-p}$, and the third pulse 2306 is appended to the central pulse 2302 at $t_{0+r}$. As illustrated in FIG. 23, the growth phase of the second pulse 2304 may start at time $t_{0-y}$, and the decay phase of the second pulse 2304 may end at time $t_{0-p}$. That is, the second pulse 2304 may be defined between time $t_{0-y}$ and time $t_{0-p}$. The growth phase of the third pulse 2306 may start at time $t_{0+r}$, and the decay phase of the third pulse 2306 may end at time $t_{0+x}$. That is, the third pulse 2306 may be defined between time $t_{0+r}$ and time $t_{0+x}$. One of skill in the art will appreciate that p and r are not necessarily equal, as the decay of the second pulse 2304 may be longer or shorter than the growth phase of the third pulse 2306 and aligning the centroids accordingly may require different timing relative to $t_0$ of each, despite an intended resultant equal distribution of the centroid location in time.

FIG. 23 illustrates three discrete pulses 2302, 2304, 2306 that grow from the centroid at time $t_0$ of a sigmoid function representing a given color sub code (e.g., the color sub code represented by the single sigmoid function 1826 of FIG. 22) toward the edges of the sigmoid function. The central pulse 2302 is used in combination with the second pulse 2304 and the third pulse 2306 in order to create 256 modulation steps per field (i.e., color).

The pulses 2302, 2304, 2306 illustrated in FIG. 23 may be used in connection with a computer implemented method for warping multi-field color virtual content for sequential projection. For example, when first and second color fields (e.g., one or more of red, blue, or green) having different first and second colors (e.g., sub codes of red, blue, or green) are obtained, a first time for projection of a warped first color field may be determined. Upon predicting a first pose corresponding to the first time (e.g., time $t_0$), for each one color among the first colors in the first color field, an input representing the one color (e.g., the color sub code represented by the single sigmoid function 1824 of FIG. 22) among the first colors in the first color field may be identified, and the input may be reconfigured as a series of pulses (e.g., central pulse 2302 centered at a first time $t_0$, second pulse 2304 and third pulse 2306) creating one or more per-field inputs. Each one of the series of pulses may be warped based on the first pose. Then, the warped first color field may be generated based on the warped series of pulses; and pixels on a sequential display may be activated based on the warped series of pulses to display the warped first color field.

In some embodiments, the central pulse 2302 may include a series of short time slots ($ts_{1-1}$, $ts_{1-2}$, $ts_{1-3}$, $ts_{1-4}$, $ts_{1-5}$, $ts_{1-6}$), arranged from the center outward. That is, time slots $ts_{1-1}$, $ts_{1-2}$ are formed next to the centroid at time $t_0$. Time slots $ts_{1-3}$, $ts_{1-4}$, $ts_{1-5}$, $ts_{1-6}$ are arranged with respect to the time slots $ts_{1-1}$, $ts_{1-2}$ to go outward from time $t_0$. The pixel on the display device (e.g., LCoS pixel) may be activated or not activated during each time slot ($ts_{1-1}$, $ts_{1-2}$, $ts_{1-3}$, $ts_{1-4}$, $ts_{1-5}$, $ts_{1-6}$). That is, the pixels on the sequential display may be activated during a subset of the time slots of the central pulse 2302. The pixels on the sequential display may be activated depending on the sub code associated with the central pulse 2302. In some embodiments, only a subset of the time slots may be turned on. For example, for the lowest color codes, only the center time slots (e.g., $ts_{1-1}$, $ts_{1-2}$), may be turned on (i.e., only the center time slots may result in activated pixels on the display device). The higher the color code, the more time slots may be turned on from the center outward.

According to some embodiments, the second pulse 2304 and the third pulse 2306 may include larger time slots than the time slots ($ts_{1-1}$, $ts_{1-2}$, $ts_{1-3}$, $ts_{1-4}$, $ts_{1-5}$, $ts_{1-6}$) of the central pulse 2302. For example, the second pulse 2304 may include time slots ($ts_{1-1}$, $ts_{2-2}$, $ts_{2-3}$, $ts_{2-4}$) that are longer (i.e., greater) in duration than the time slots ($ts_{1-1}$, $ts_{1-2}$, $ts_{1-3}$, $ts_{1-4}$, $ts_{1-5}$, $ts_{1-6}$) of the central pulse 2302. The time slots ($ts_{1-1}$, $ts_{2-2}$, $ts_{2-3}$, $ts_{2-4}$) of the second pulse 2304 may be arranged from later to earlier. That is, the time slot $ts_{2-1}$ occurs later in time with respect to time slots $ts_{2-2}$, $ts_{2-3}$, $ts_{2-4}$ within the second pulse 2304. Similarly, the third pulse 2306 may include time slots ($ts_{3-1}$, $ts_{3-2}$, $ts_{3-3}$, $ts_{3-4}$) that are longer in duration than the time slots ($ts_{1-1}$, $ts_{1-2}$, $ts_{1-3}$, $ts_{1-4}$, $ts_{1-5}$, $ts_{1-6}$) of the central pulse 2302. The time slots ($ts_{3-1}$, $ts_{3-2}$, $ts_{3-3}$, $ts_{3-4}$) of the third pulse 2306 may be arranged from earlier to later. That is, the time slot $ts_{3-1}$ occurs earlier in time with respect to time slots $ts_{3-2}$, $ts_{3-3}$, $ts_{3-4}$ within the third pulse 2306. Accordingly, the pulses may be arranged to grow outward from the central pulse 2302.

In some embodiments, the pixels on the sequential display may be activated during a subset of the time slots of the second pulse 2304 and/or the third pulse 2306. As time slots are turned on in the second pulse 2304 and the third pulse 2306 to create higher color codes, care is taken to turn on a slot in the second pulse 2304 and a corresponding slot the third pulse 2306 together to maintain the overall centroid in the color code. If system constraints require, as they often do, to turn on a single slot in the second pulse 2304 or the third pulse 2306 for adjacent codes, care is taken to keep the additional slot short or use spatial/temporal dithering to prevent too big a shift in the light energy from the centroid. This also avoids additional contouring artifacts with head or eye motion.

The central pulse 2302 can be thought of as the least significant bits (LSBs) of a digital color code, while the second pulse 2304 and the third pulse 2306 are similar to the most significant bits (MSBs) of the digital color code. The combination of the central pulse 2302 with the second pulse 2304 and the third pulse 2306 yields many possible combinations that can be used for building the 256 modulation steps.

For maximum brightness, a single pulse may need to be created for the highest modulation step, merging the central pulse 2302, the second pulse 2304 and the third pulse 2306. In the transition from three pulses to one pulse, smaller time slots may be turned on to keep the step size small. In this case, smaller slots may be added at the beginning of the second pulse 2304, arranged later to earlier. For example, as illustrated in FIG. 23 the time slot $ts_{2-4}$ (i.e., the time slot at the beginning of the second pulse 2304) may be divided into smaller time slots ($ts_{2-4-1}$, $ts_{2-4-2}$, $ts_{2-4-3}$) arranged later to earlier. That is, the time slot $ts_{2-4-1}$ occurs later in time with respect to time slots $ts_{2-4-2}$, and $ts_{2-4-3}$ within the second pulse 2304. Similarly, smaller slots are added to the end of the third pulse 2306, arranged earlier to later. For example, as illustrated in FIG. 23 the time slot $ts_{3-4}$ (i.e., the time slot at the end of the third pulse 2306) may be divided into smaller time slots ($ts_{3-4-1}$, $ts_{3-4-2}$, $ts_{2-4-3}$) arranged earlier to later. That is, the time slot $ts_{3-4-1}$ occurs earlier in time with respect to time slots $ts_{3-4-2}$, and $ts_{3-4-3}$ within the third pulse 2306. In both cases, the short time slots (i.e., $ts_{2-4-1}$, $ts_{2-4-2}$, $ts_{2-4-3}$ and $ts_{3-4-1}$, $ts_{3-4-2}$, $ts_{2-4-3}$) are arranged in the same direction as the larger time slots (i.e., $ts_{2-1}$, $ts_{2-2}$, $ts_{2-3}$, $ts_{2-4}$ and $ts_{3-1}$, $ts_{3-2}$, $ts_{3-3}$, $ts_{3-4}$) of their respective pulse (i.e., the second pulse 2304 and the third pulse 2306).

As many light modulators (e.g., LCoS, lasers in scanned displays, digital light processing (DLP), liquid crystal display (LCD), and/or other display technologies) have asymmetric turn on and off times, the three pulse lengths and arrangement of the pulses, may need to be asymmetric in order to keep the centroid at a fixed point. If the turn on time is longer than the turn off time, for example, the centroid will be later in the field than the center time. According to various embodiments, each of the three pulses may be constructed in a similar fashion with asymmetrical slot lengths and arrangements.

The combination of the pulse lengths of the central pulse 2302 and the second and third pulses 2304, 2306 may produce more than 256 possible combinations. A subset of these combinations is used to create the 256 modulation steps. The combinations may be selected based on a number of factors including: closest match to desired brightness response curve (i.e., linear gamma, standard red green blue (sRGB) gamma), smallest variation in centroid across all color codes, smallest variation in centroid for adjacent color codes, and smaller brightness variation for that combination across temperature and process.

As the turn on and turn off times may vary with temperature, voltage, process, and other variables, a different set of 256 combinations may be chosen for different conditions. For example, a first set for cool temperatures may be chosen when the device is first turning on, and a different second set may be chosen for when the device has heated up and reached steady state temperature. Any number of sets may be used to limit contouring and maximize image quality across operating conditions.

Figure 24:
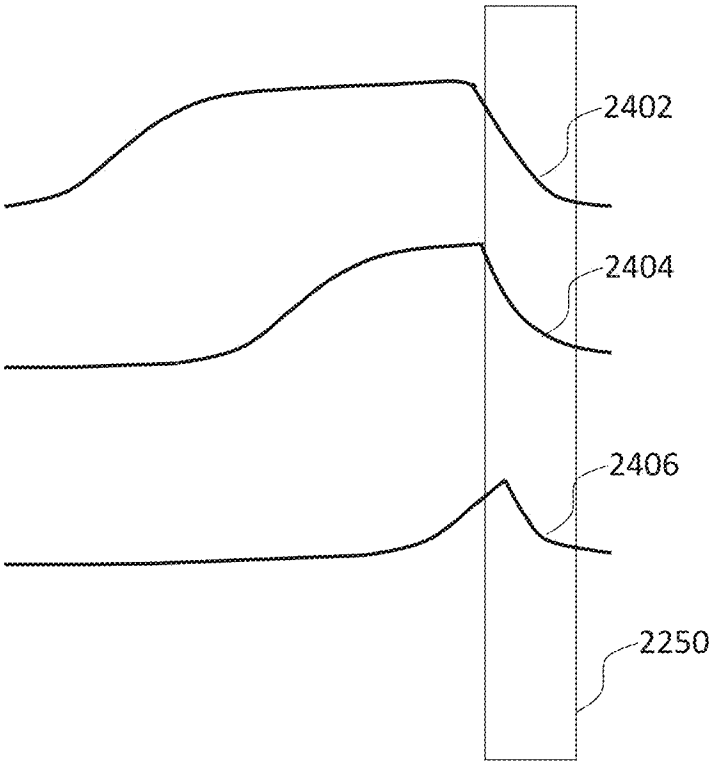
FIG. 24 depicts adverse effects of non-symmetric sub code illumination.

In some embodiments, the symmetric nature of the bit depth timing in FIG. 23 prevents overly bright or overly dark streaks, as interference among the sub codes (depending on direction of motion from left to right of the head pose) are mitigated. That is, if the sub codes were not temporally adjusted, and a user moved their head in a particular direction, the bits of a particular sub code may appear at a location that presents color information where none is intended to appear simply by poor timing of the bit depth sigmoid form for the sub code. As illustrated in FIG. 24, zone 2250 depicts a region where the head motion may place a particular sub code 2406 to present color when two other sub codes 2402 and 2404 in the same field are in a decay phase, and inadvertently display pixels when no color of any sub code is intended to be displayed to a user based on the given head pose timing sample. One of skill in the art will appreciate that additional configurations are possible to build desired bit depth of one or more sub codes.

Figure 25:
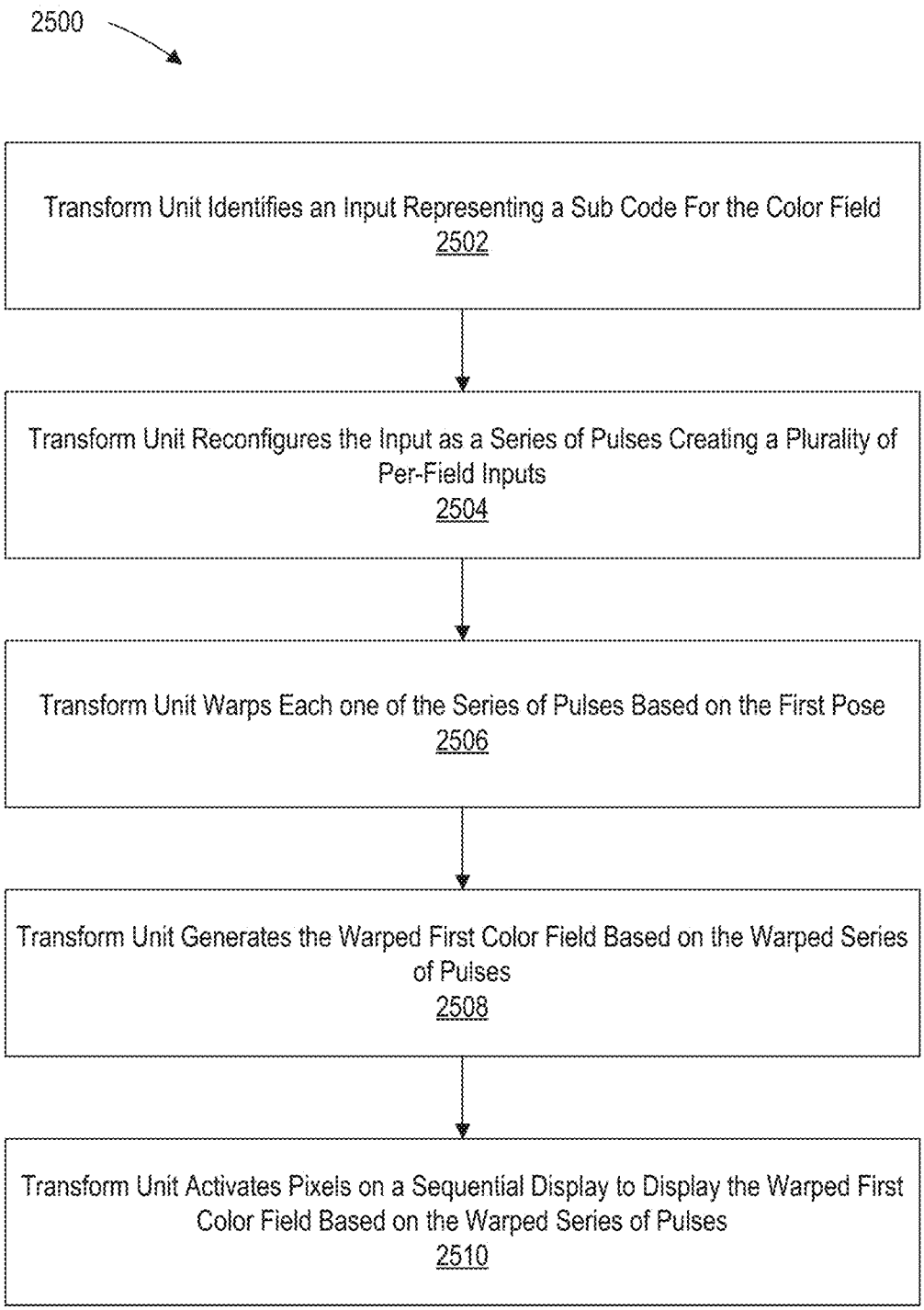
FIG. 25 depicts a method of warping multi-field (color) virtual content, according to some embodiments.

FIG. 25 depicts a method of warping coloring virtual content, according to some embodiment. The steps depicted at FIG. 25 may be performed for each color field (R, G, B). In some embodiments, the steps depicted at FIG. 25 may be performed as sub-steps of steps 816R, 816G and/or 816B.

Each color field (R, G, B) includes one or more colors each represented by a sub code. For each color (e.g., sub code) among the one or more colors of a selected color field, at step 2502, the pose estimator identifies an input (e.g., a sigmoid) representing a sub code for the color field. At step 2504, the pose estimator reconfigures the input as a series of pulses (e.g., three pulses), creating one or more per-field inputs. At step 2506, the transform unit warps each one of the series of pulses based on the first pose. At step 2508, the transform unit generates the warped first color field based on the warped series of pulses. At Step 2510, the transform unit activates pixels on the sequential display to display the warped first color field based on the warped series of pulses. The same steps 2502-2510 may be performed for all color fields (R, G, B).

The disclosure includes methods that may be performed using the subject devices. The methods may comprise the act of providing such a suitable device. Such provision may be performed by the user. In other words, the "providing" act merely requires the user obtain, access, approach, position, set-up, activate, power-up or otherwise act to provide the requisite device in the subject method. Methods recited herein may be carried out in any order of the recited events which is logically possible, as well as in the recited order of events.

Exemplary aspects of the disclosure, together with details regarding material selection and manufacture have been set forth above. As for other details of the present disclosure, these may be appreciated in connection with the above-referenced patents and publications as well as generally known or appreciated by those with skill in the art. The same may hold true with respect to method-based aspects of the disclosure in terms of additional acts as commonly or logically employed.

In addition, though the disclosure has been described in reference to several examples optionally incorporating various features, the disclosure is not to be limited to that which is described or indicated as contemplated with respect to each variation of the disclosure. Various changes may be made to the disclosure described and equivalents (whether recited herein or not included for the sake of some brevity) may be substituted without departing from the true spirit and scope of the disclosure. In addition, where a range of values is provided, it is understood that every intervening value, between the upper and lower limit of that range and any other stated or intervening value in that stated range, is encompassed within the disclosure.

Also, it is contemplated that any optional feature of the inventive variations described may be set forth and claimed independently, or in combination with any one or more of the features described herein. Reference to a singular item, includes the possibility that there are plural of the same items present. More specifically, as used herein and in claims associated hereto, the singular forms "a," "an," "said," and "the" include plural referents unless the specifically stated otherwise. In other words, use of the articles allow for "at least one" of the subject item in the description above as well as claims associated with this disclosure. It is further noted that such claims may be drafted to exclude any optional element. As such, this statement is intended to serve as antecedent basis for use of such exclusive terminology as "solely," "only" and the like in connection with the recitation of claim elements, or use of a "negative" limitation.

Without the use of such exclusive terminology, the term "comprising" in claims associated with this disclosure shall allow for the inclusion of any additional element—irrespective of whether a given number of elements are enumerated in such claims, or the addition of a feature could be regarded as transforming the nature of an element set forth in such claims. Except as specifically defined herein, all technical and scientific terms used herein are to be given as broad a commonly understood meaning as possible while maintaining claim validity.

The breadth of the present disclosure is not to be limited to the examples provided and/or the subject specification, but rather only by the scope of claim language associated with this disclosure.

In the foregoing specification, the disclosure has been described with reference to specific embodiments thereof. It will, however, be evident that various modifications and changes may be made thereto without departing from the broader spirit and scope of the disclosure. For example, the above-described process flows are described with reference to a particular ordering of process actions. However, the ordering of many of the described process actions may be changed without affecting the scope or operation of the disclosure. The specification and drawings are, accordingly, to be regarded in an illustrative rather than restrictive sense.

What is claimed is:

1. A computer implemented method for warping multi-field color virtual content for sequential projection comprising:

obtaining a primary color field including a plurality of colors, wherein each of the plurality of colors represents a different shade of the primary color field;

determining a first time for projection of a warped primary color field;

predicting a pose corresponding to the first time;

for a selected one color among the plurality of colors in the primary color field:

identifying an input representing the selected one color among the plurality of colors in the primary color field;

reconfiguring the input as a series of pulses creating a plurality of per-field inputs;

warping each one of the series of pulses based on the pose, wherein the selected one color among the plurality of colors in the primary color field is warped individually;

generating the warped primary color field based on the warped series of pulses; and activating pixels on a sequential display based on the warped series of pulses to display the warped primary color field.

2. The method of claim 1, wherein the series of pulses includes a central pulse centered at the first time, a second pulse occurring before the central pulse and a third pulse occurring after the central pulse.

3. The method of claim 2, wherein an end of a decay phase of the second pulse is temporally aligned with a beginning of a growth phase of the central pulse, and a beginning of a growth phase of the third pulse is temporally aligned with an end of a decay phase of the central pulse.

4. The method of claim 2, wherein a centroid of the central pulse occurs at the first time, a centroid of the second pulse occurs at a second time before the first time, and a centroid of the third pulse occurs at a third time after the first time.

5. The method of claim 4, wherein a difference between the first time and the second time is equal to a difference between the first time and the third time.

6. The method of claim 2, wherein the central pulse includes a first set of time slots each having a first duration, the second pulse and the third pulse includes a second set of time slots each having a second duration greater than the first duration.

7. The method of claim 6, wherein the pixels on the sequential display are activated during a subset of the first set of time slots or the second set of time slots.

8. The method of claim 7, wherein the pixels on the sequential display are activated during time slots of the central pulse depending on a color code associated with the selected one color among the colors in the primary color field.

9. The method of claim 7, wherein the pixels on the sequential display are activated for a time slot in the second pulse and a corresponding time slot in the third pulse.

10. The method of claim 1, wherein the primary color field is one of a red, green or blue color field.

11. A system for warping multi-field color virtual content for sequential projection, comprising:

a warping unit to receive a primary color field including a plurality of colors, wherein each of the plurality of colors represents a different shade of the primary color field, the warping unit comprising:

a pose estimator to determine a first time for projection of a warped primary color field and to predict a pose corresponding to the first time; and a transform unit to:

for a selected one color among the plurality of colors in the primary color field:

identifying an input representing the one selected color among the plurality of colors in the primary color field;

reconfiguring the input as a series of pulses creating a plurality of per-field inputs;

warping each one of the series of pulses based on the pose, wherein the selected one color among the plurality of colors in the primary color field is warped individually;

generating the warped primary color field based on the warped series of pulses; and activating pixels on a sequential display based on the warped series of pulses to display the warped primary color field.

12. The system of claim 11, wherein the series of pulses includes a central pulse centered at the first time, a second pulse occurring before the central pulse and a third pulse occurring after the central pulse.

13. The system of claim 12, wherein an end of a decay phase of the second pulse is temporally aligned with a beginning of a growth phase of the central pulse, and a beginning of a growth phase of the third pulse is temporally aligned with an end of a decay phase of the central pulse.

14. The system of claim 12, wherein a centroid of the central pulse occurs at the first time, a centroid of the second pulse occurs at a second time before the first time, and a centroid of the third pulse occurs at a third time after the first time.

15. The system of claim 12, wherein the central pulse includes a first set of time slots each having a first duration, the second pulse and the third pulse includes a second set of time slots each having a second duration greater than the first duration.

16. The system of claim 15, wherein the pixels on the sequential display are activated during a subset of the first set of time slots or the second set of time slots.

17. The system of claim 16, wherein the pixels on the sequential display are activated during time slots of the central pulse depending on a color code associated with the selected one color among the colors in the primary color field.

18. The system of claim 16 wherein the pixels on the sequential display are activated for a time slot in the second pulse and a corresponding time slot in the third pulse.

19. A computer implemented method for warping multi-field color virtual content for sequential projection comprising:

obtaining a first primary color field including a plurality of first colors, and a second primary color field including a plurality of second colors different than the plurality of first colors of the first primary color field, wherein each of the plurality of first colors represents a different shade of the first primary color field, wherein each of the plurality of second colors represents a different shade of the primary second color field;

for each one of the first primary color field and the second primary color field:

determining a first time for projection of a warped primary color field;

predicting a pose corresponding to the first time;

for each one color among the plurality of colors in the primary color field:

identifying an input representing the one color among the plurality of colors in the primary color field;

reconfiguring the input as a series of pulses creating a plurality of per-field inputs;

warping each one of the series of pulses based on the pose, wherein each color among the plurality of colors in the primary color field is warped individually;

generating the warped primary color field based on the warped series of pulses corresponding to all of the plurality of colors in the primary color field; and activating pixels on a sequential display based on the warped series of pulses to display the warped primary color field.

* * * * *